US012733720B1

(12) United States Patent
Sibbesen et al.

(10) Patent No.: US 12,733,720 B1
(45) Date of Patent: Sep. 15, 2026

(54) PORTABLE ELECTRONIC DEVICE CASE MODULAR HOLDER SYSTEM

(71) Applicant: Pioneer Square Brands, Inc., High Point, NC (US)

(72) Inventors: Soren Sibbesen, Jamestown, NC (US); Brian Lewis Piper, Seattle, WA (US); Quentin Wade Forbes, Winston Salem, NC (US); Richard Kennedy, Antioch, TN (US)

(73) Assignee: Pioneer Square Brands, Inc., HIgh Point, NC (US)

( * ) Notice: Subject to any disclaimer, the term of this patent is extended or adjusted under 35 U.S.C. 154(b) by 0 days.

(21) Appl. No.: 19/411,256

(22) Filed: Dec. 6, 2025

Related U.S. Application Data

(60) Provisional application No. 63/789,384, filed on Apr. 15, 2025.

(51) Int. Cl.
*A45C 11/00* (2006.01)
*A45C 13/04* (2006.01)

(52) U.S. Cl.
CPC ..... *A45C 11/003* (2025.01); *A45C 13/04* (2013.01)

(58) Field of Classification Search
CPC ... H04B 1/3888; H04B 1/3877; A45C 11/003; A45C 11/002; A45C 11/04; A45C 11/34; A45C 2013/025; G06F 1/1628; G06F 2200/1632; G06F 3/03545; B43K 23/001; B43K 23/00; B43K 23/08; B43K 23/10; B43K 23/12
See application file for complete search history.

(56) References Cited

U.S. PATENT DOCUMENTS

| | | | | |
|---|---|---|---|---|
| 10,806,227 | B1 * | 10/2020 | Medeiros | A45C 11/34 |
| D1,065,166 | S * | 3/2025 | Weng | D14/253 |
| 2014/0138265 | A1 * | 5/2014 | Bong | A45C 11/00 206/37 |
| 2023/0037484 | A1 * | 2/2023 | Kang | H04B 1/3888 |
| 2023/0144918 | A1 * | 5/2023 | Zhong | G06F 1/181 361/600 |
| 2023/0361799 | A1 * | 11/2023 | Xie | H04B 1/3888 |

OTHER PUBLICATIONS

Products sold by UZBL including a pen holder attachable to case for iPad 10.2 Gen 7. Product information can be found at https://uzbl.com/products/pencil-holder-for-groove-folio-10-2.*

* cited by examiner

*Primary Examiner* — Quoc Thai N Vu
(74) *Attorney, Agent, or Firm* — Grandview Law

(57) ABSTRACT

A case system for a portable electronic device is described. The system includes a holder assembly having a front wall portion with ridge portions, a trough region configured to receive and align a stylus, pen, or pencil, and a retention member for securing the stylus, pen, or pencil within the trough region. The frame assembly includes a plurality of side portions with flange portions, a recessed structure with end portions, corner portions, a back portion, a base portion, and a bevelled edge portion. The frame assembly further defines an aperture configured to couple with the holder assembly such that the trough region remains accessible for storage and retrieval of the stylus, pen, or pencil. The holder assembly may be detachably coupled to the frame assembly without tools, and the stylus, pen, or pencil may include a conductive tip configured to interface with a display of the portable electronic device.

20 Claims, 37 Drawing Sheets

PORTABLE ELECTRONIC DEVICE CASE MODULAR HOLDER SYSTEM

In one or more aspects a case system for a portable electronic device, the system including (I) a holder assembly including (A) a front wall portion having a plurality of ridge portions, (B) a trough region configured to receive at least a portion of a stylus, pen, or pencil, the trough region including a base portion and a plurality of inner wall portions, and (C) a retention member removably couplable with the stylus, pen, or pencil within the trough region; and (II) a frame assembly including (A) a plurality of side portions, each having a flange portion, (B) a recessed structure formed at least in part by end portions, corner portions, a back portion, a base portion, and a bevelled edge portion, and (C) an aperture removably couplable with the holder assembly such that when the holder assembly is coupled with the frame assembly, the trough region is accessible for storage and retrieval of the stylus, pen, or pencil.

In implementations the holder assembly further comprises end wall portions and a back wall portion, each having outer portions removably couplable with corresponding surfaces of the frame assembly.

In implementations the retention member is integrally formed with the trough region.

In implementations the frame assembly further comprises inner wall portions removably couplable with and supporting the holder assembly.

In implementations the recessed structure includes a step portion and aperture portions removably couplable with corresponding features of the holder assembly.

In implementations the stylus, pen, or pencil is removably receivable within the trough region and retained by the retention member.

In implementations the trough region is dimensioned to receive a stylus, pen, or pencil having a predetermined diameter.

In implementations the holder assembly is removably couplable with the frame assembly without requiring tools.

In implementations a case system for a portable electronic device, the system including (I) a frame assembly removably couplable with the portable electronic device, the frame assembly including a recessed structure with end portions, corner portions, and a beveled edge portion; and (II) a holder assembly including a front wall portion with ridge portions, a trough region configured to store a stylus, pen, or pencil, and a retention member, wherein the holder assembly is removably couplable with the frame assembly and defines a continuous outer surface with the frame assembly when assembled.

In implementations the ridge portions are positioned to guide and align the stylus, pen, or pencil during insertion.

In implementations the retention member comprises an elastomeric or resilient material to facilitate repeated insertion and removal of the stylus, pen, or pencil.

In implementations the holder assembly is removably couplable with the frame assembly without tools.

In implementations the frame assembly further comprises inner wall portions and flange portions removably couplable with and supporting the holder assembly.

In implementations the trough region includes the base portion and aligns the stylus, pen, or pencil parallel to the front wall portion.

In one or more aspects a case system for a portable electronic device, the system including (I) a frame assembly including a plurality of side portions, a recessed structure with a bevelled edge portion, and an aperture; and (II) a holder assembly including a trough region dimensioned to receive a stylus, pen, or pencil, and a retention member removably couplable with the stylus, pen, or pencil within the trough region, wherein the frame assembly is removably couplable with the holder assembly and the portable electronic device such that the holder assembly remains accessible when the portable electronic device is positioned within the frame assembly.

In implementations the portable electronic device is removably couplable with the frame assembly while the holder assembly remains coupled.

In implementations the stylus, pen, or pencil comprises a conductive tip removably couplable with a display of the portable electronic device.

In implementations the frame assembly and holder assembly together define a continuous exterior profile when assembled.

In implementations the trough region is dimensioned to receive a stylus, pen, or pencil having a predetermined diameter.

In implementations the holder assembly further comprises a front wall portion with ridge portions that provide structural stiffness and alignment guidance.

In addition to the foregoing, other aspects are described in the claims, drawings, and text forming a part of the disclosure set forth herein. Various other aspects are set forth and described in the teachings such as text (e.g., claims and/or detailed description) and/or drawings of the present disclosure. The foregoing is a summary and thus may contain simplifications, generalizations, inclusions, or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of Portable Electronic Device Case Modular Holder System, articles of manufacture, compositions of matter for same that may provide context, for instance, in introducing one or more processes and/or devices described herein.

DETAILED DESCRIPTION

Figure 1:
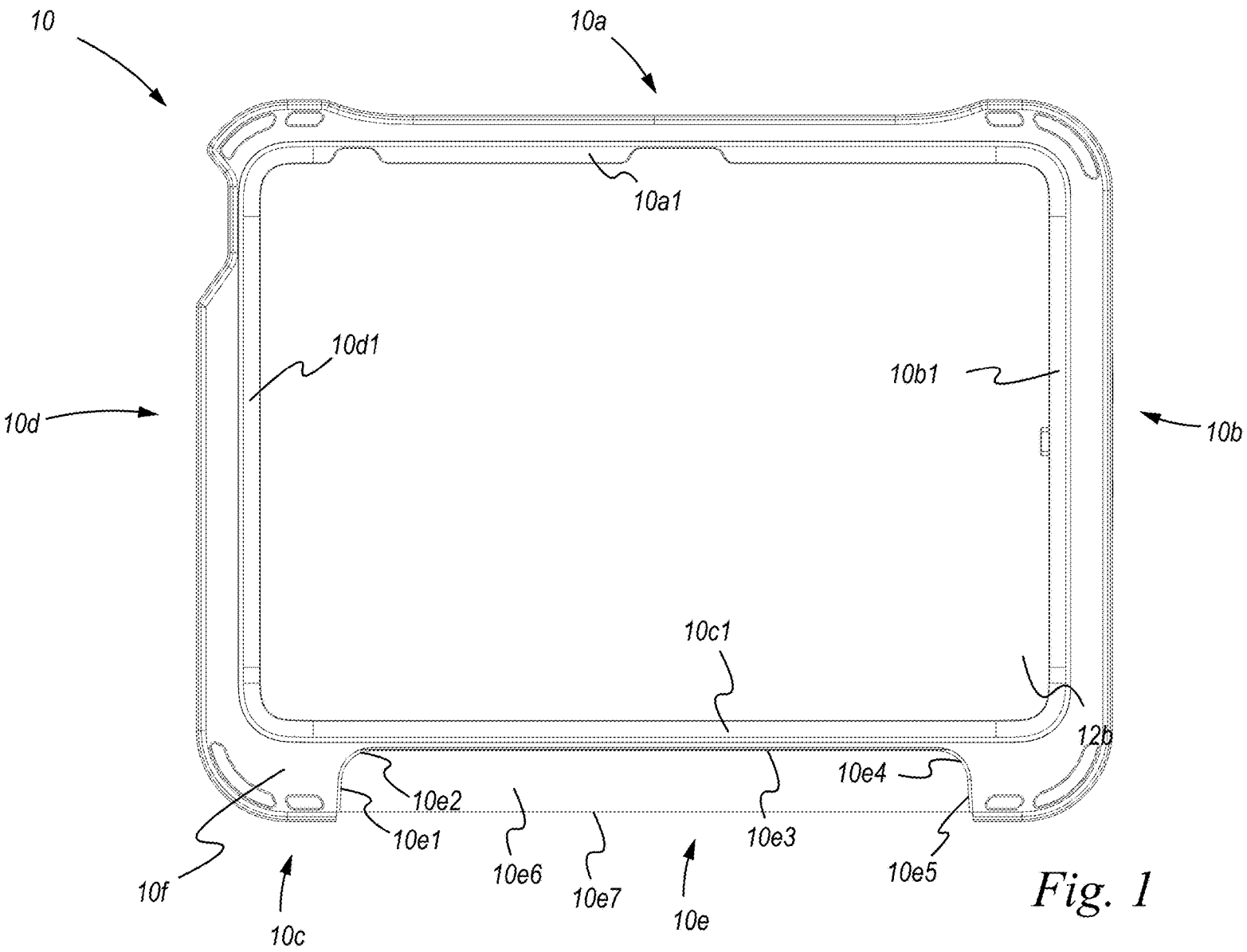
FIG. 1 is a top plan view of a frame assembly.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is a top plan view of frame assembly 10 including side portion 10*a* with flange portion 10*al* and inner wall portion 10*a*2, side portion 10*b* with flange portion 10*b*1 and inner wall portion 10*b*2, side portion 10*c* with flange portion 10*cl* and inner wall portion 10*c*2, side portion 10*d* with flange portion 10*d*1 and inner wall portion 10*d*2, and recessed structure 10*e* with end portions 10*e*1 and 10*e*5, corner portions 10*e*2 and 10*e*4, back portion 10*e*3, base portion 10*e*6, beveled edge portion 10*e*7, and outer face portions 10*e*8 and 10*g*. In implementations, the flange portions may define a cavity configured to receive and support a holder assembly. The bevelled edge portion can facilitate guided coupling of the holder assembly to the frame assembly. The inner wall portions may further support the holder assembly, and the outer face portions can provide external reinforcement and alignment features.

Figure 2:
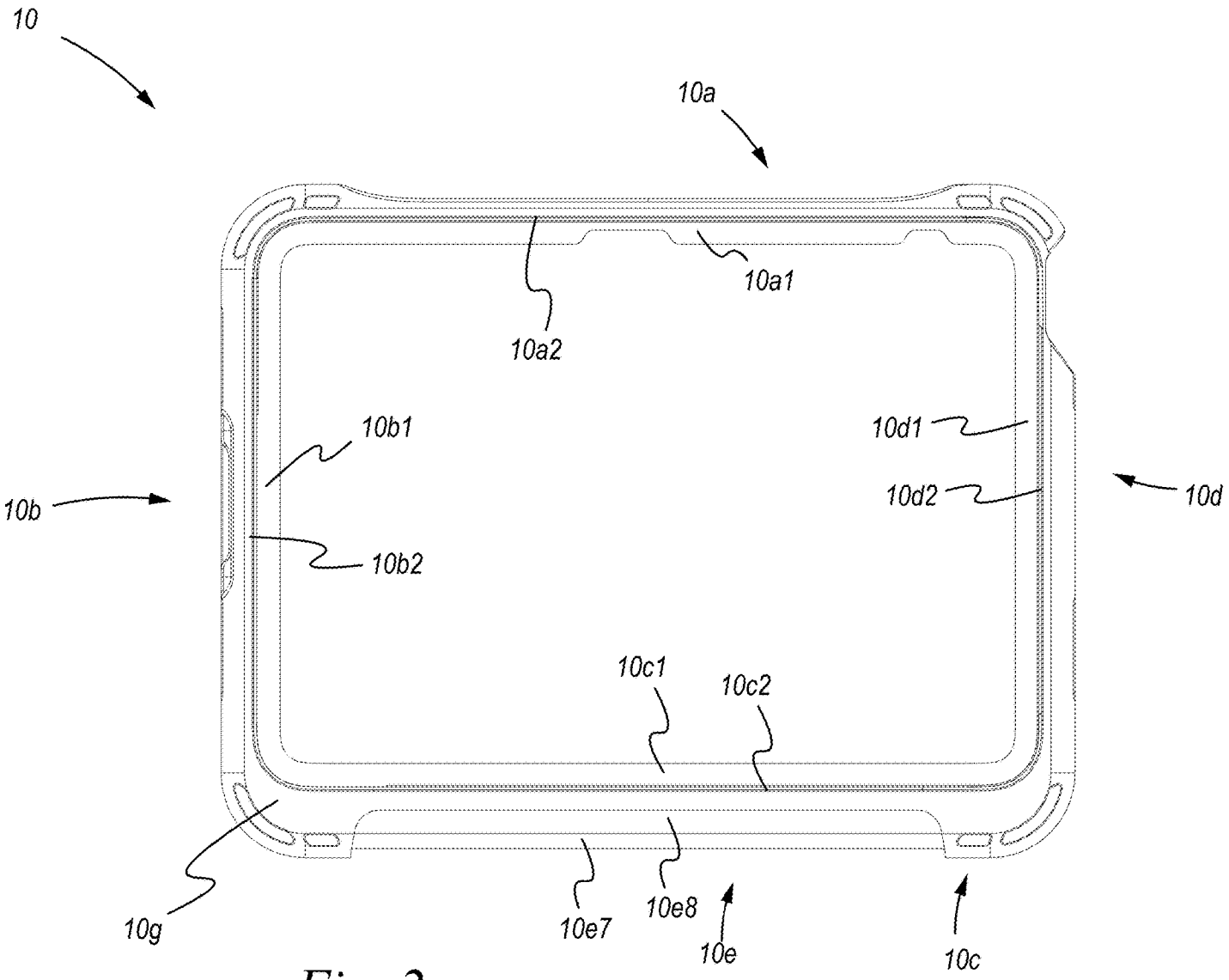
FIG. 2 is a bottom plan view of the frame assembly of FIG. 1.

Turning to FIG. 2, depicted therein is a bottom plan view of frame assembly 10 including side portion 10*a* with inner wall portion 10*a*2, side portion 10*b* with inner wall portion 10*b*2, side portion 10*c* with inner wall portion 10*c*2, and side portion 10*d* with inner wall portion 10*d*2. In implementations, these inner wall portions can assist in stabilizing the holder assembly when coupled and may engage corresponding surfaces of the holder assembly for a secure fit.

Figure 3:
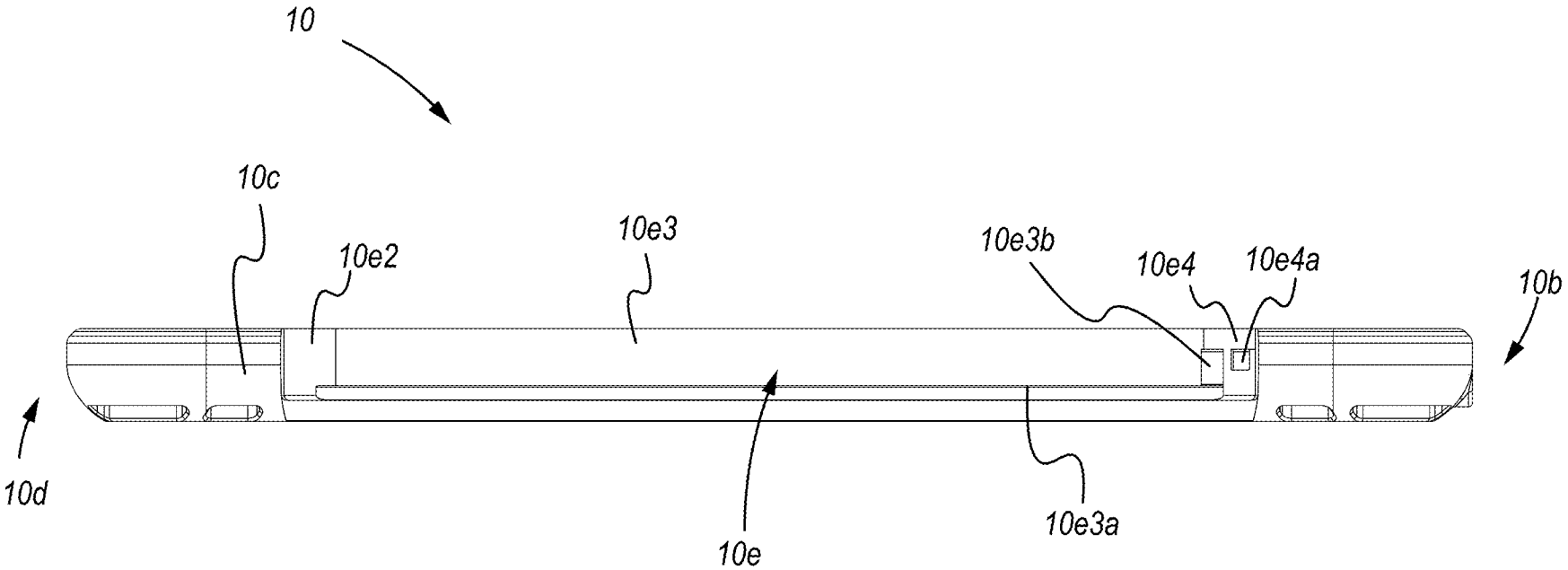
FIG. 3 is a left side elevational view of the frame assembly of FIG. 1.

Turning to FIG. 3, depicted therein is a left side elevational view of frame assembly 10 including recessed structure 10*e* with step portion 10*e*3*a*, aperture portion 10*e*3*b*, and aperture portion 10*e*4*a*. The step portion and aperture portions can receive corresponding features of the holder assembly to enable secure and repeatable engagement, including tool-less attachment.

Figure 4:
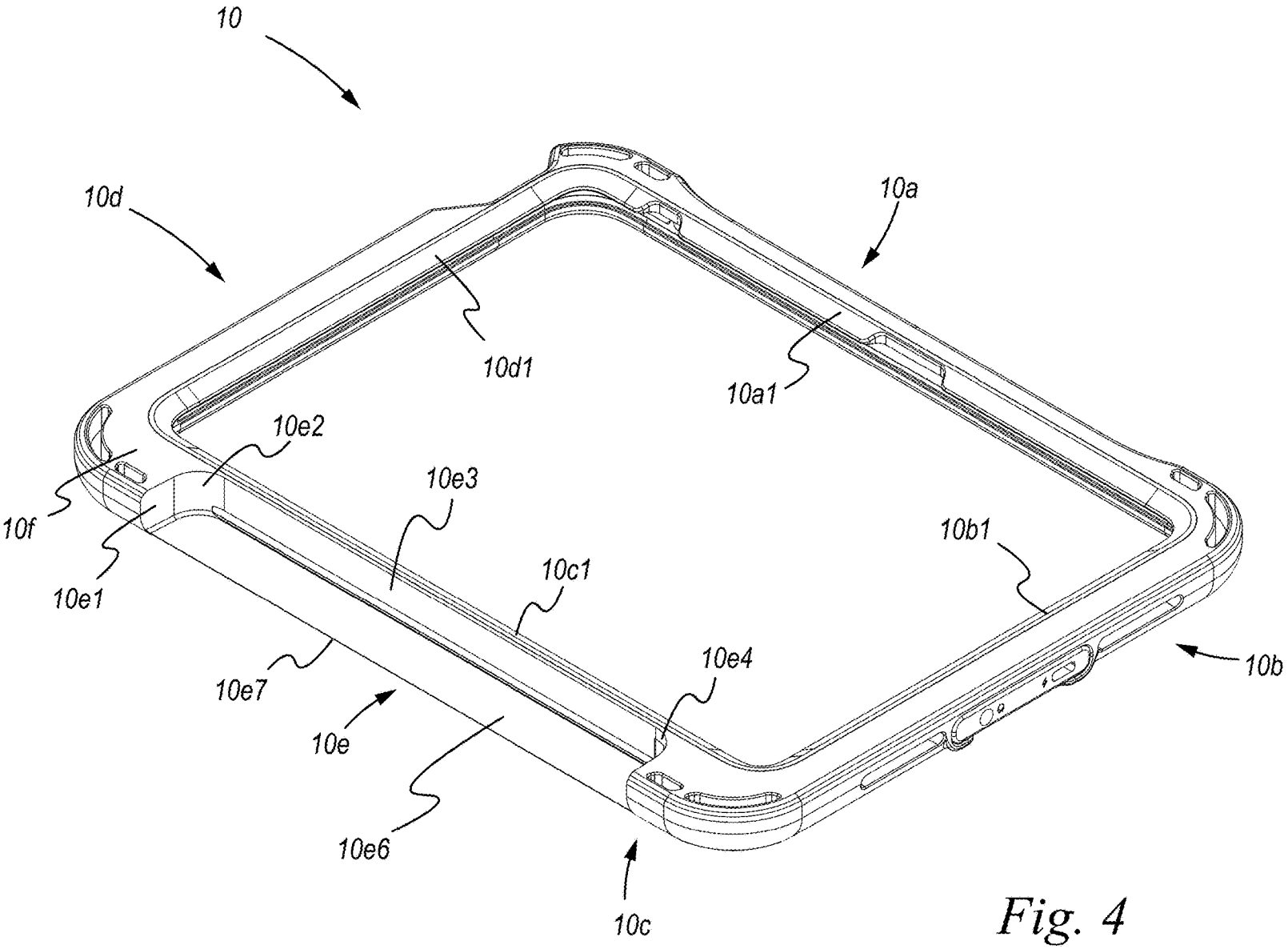
FIG. 4 is a right front top perspective view of the frame assembly of FIG. 1.

Turning to FIG. 4, depicted therein is a right front top perspective view of frame assembly 10. In some implementations, the frame assembly can be configured to receive a portable electronic device, providing surrounding protection and structural support.

Figure 5:
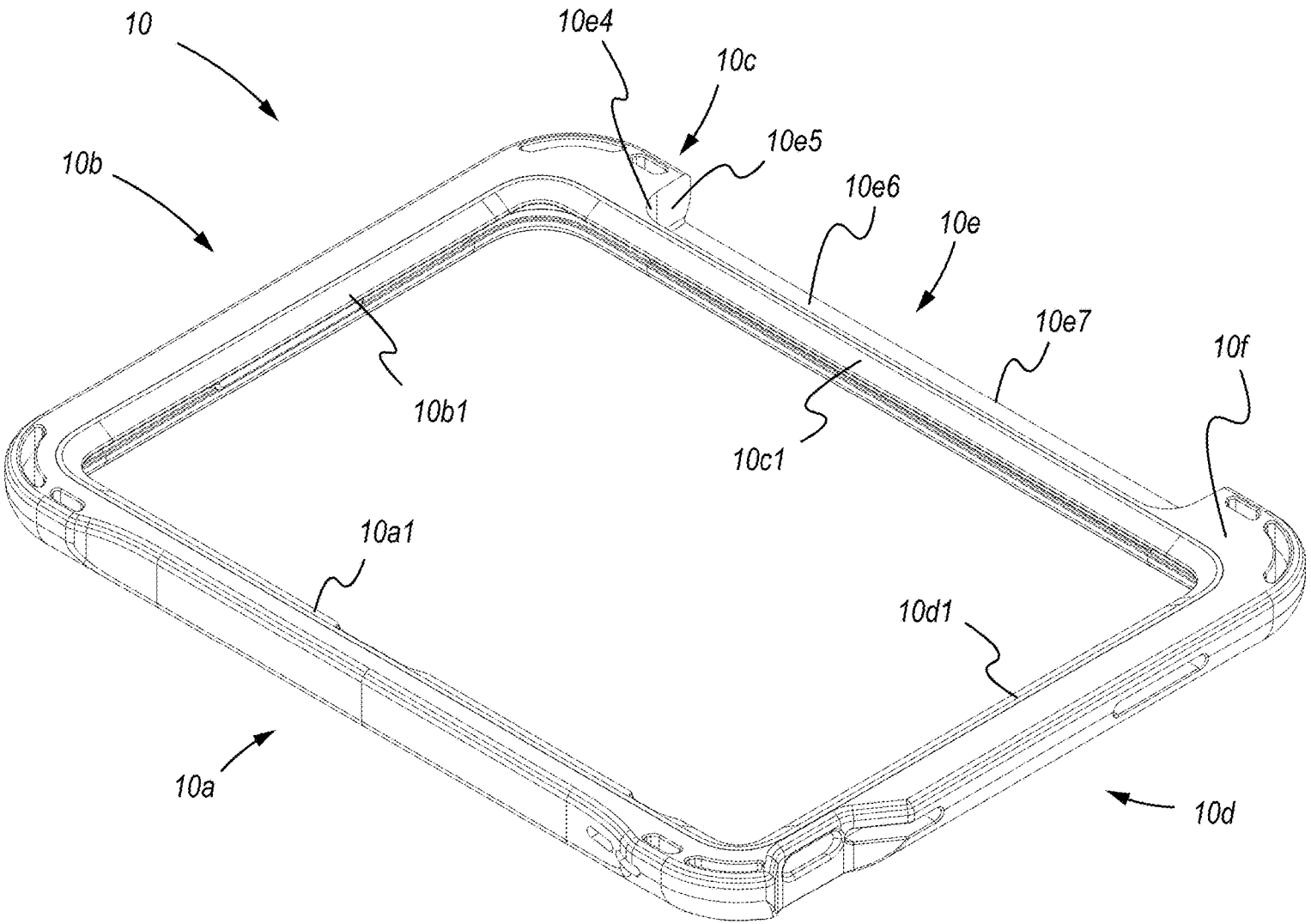
FIG. 5 is a left back top perspective view of the frame assembly of FIG. 1.

Turning to FIG. 5, depicted therein is a left back top perspective view of frame assembly 10. In examples, the arrangement of side portions, corner portions, and end portions enables precise positioning and alignment of the holder assembly.

Figure 6:
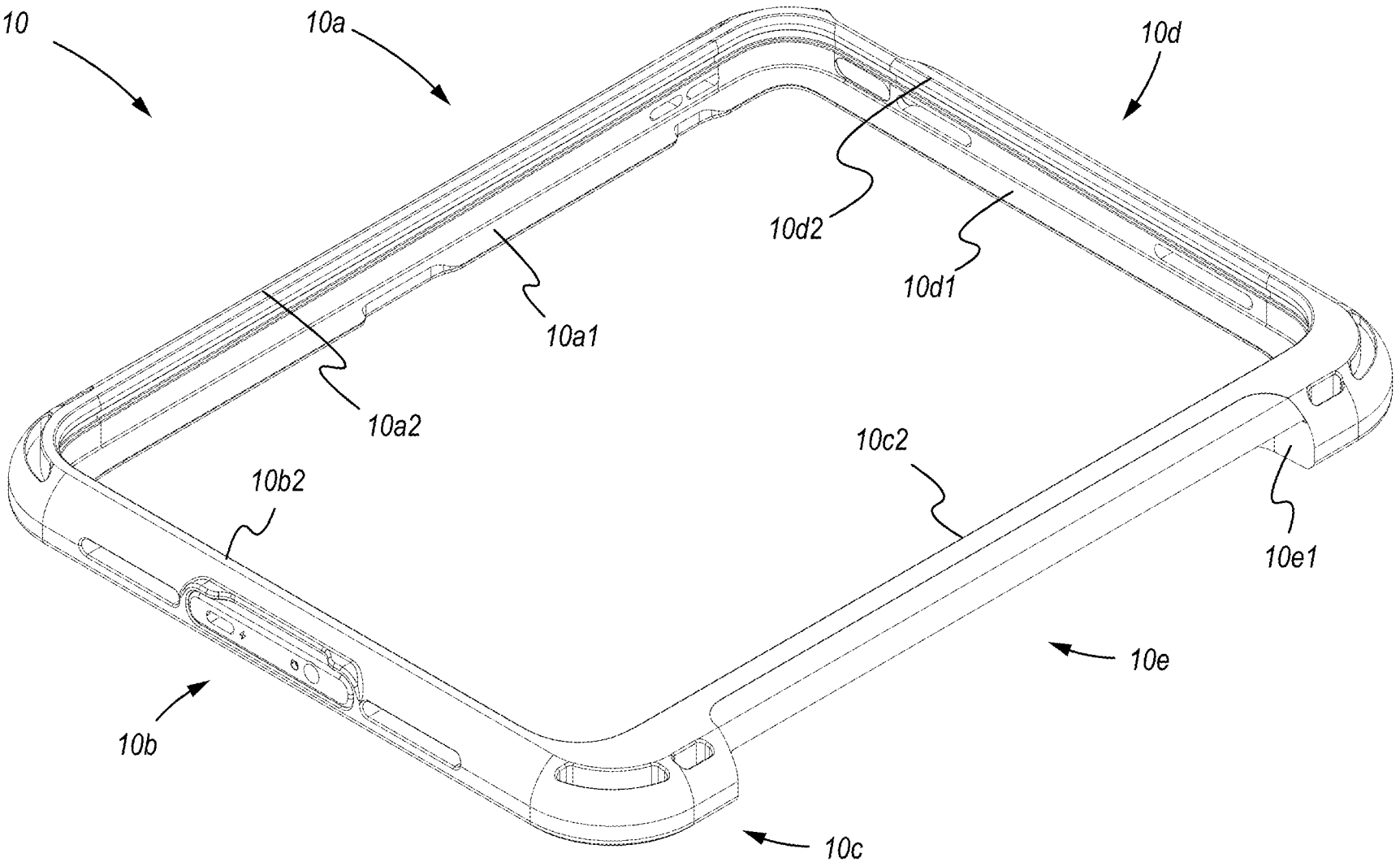
FIG. 6 is a right front bottom perspective view of the frame assembly of FIG. 1.

Turning to FIG. 6, depicted therein is a right front bottom perspective view of frame assembly 10.

Figure 7:
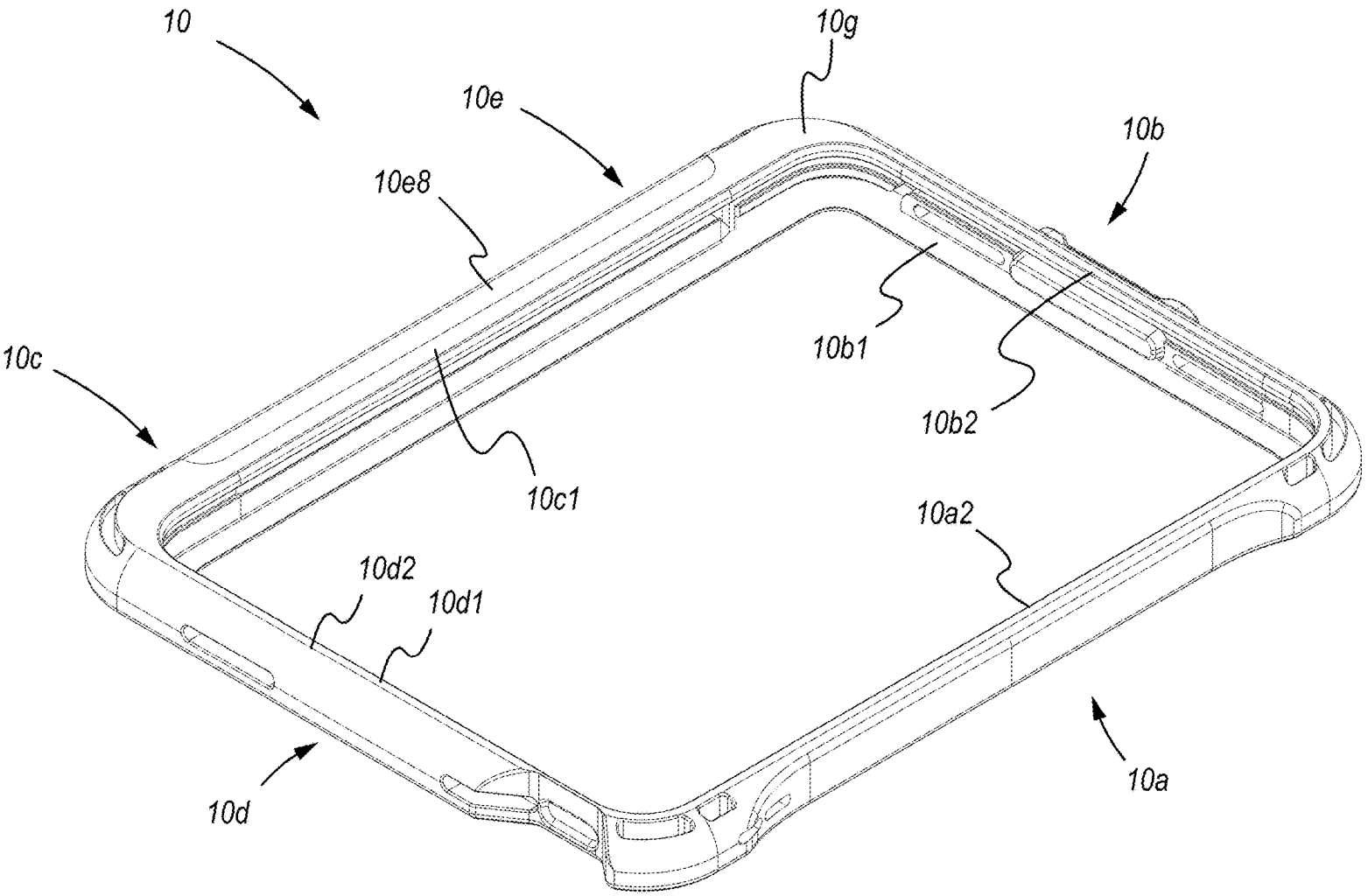
FIG. 7 is a left back bottom perspective view of the frame assembly of FIG. 1.

Turning to FIG. 7, depicted therein is a left back bottom perspective view of frame assembly 10.

Figure 8:
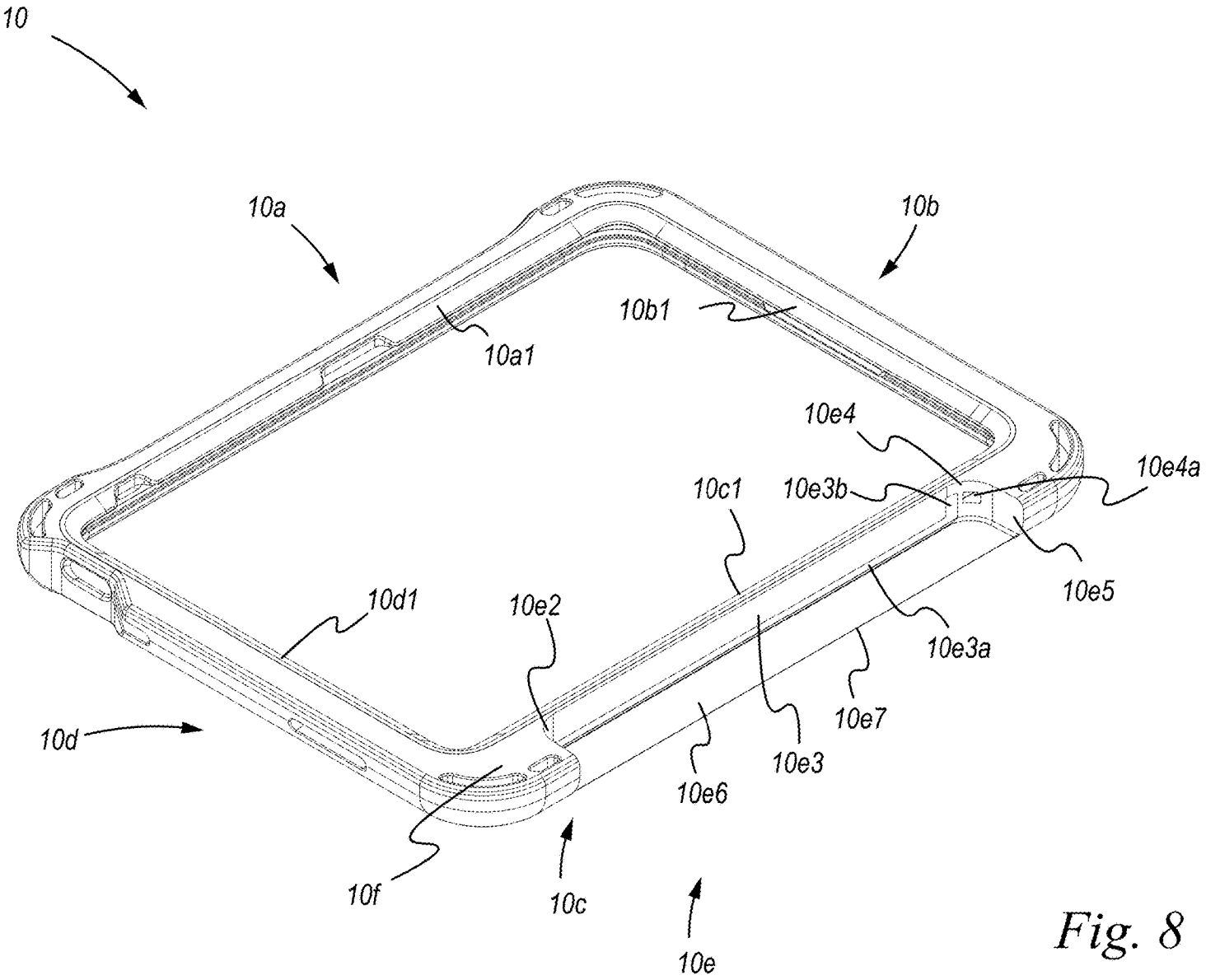
FIG. 8 is a right back top perspective view of the frame assembly of FIG. 1.

Turning to FIG. 8, depicted therein is a right back top perspective view of frame assembly 10.

Figure 9:
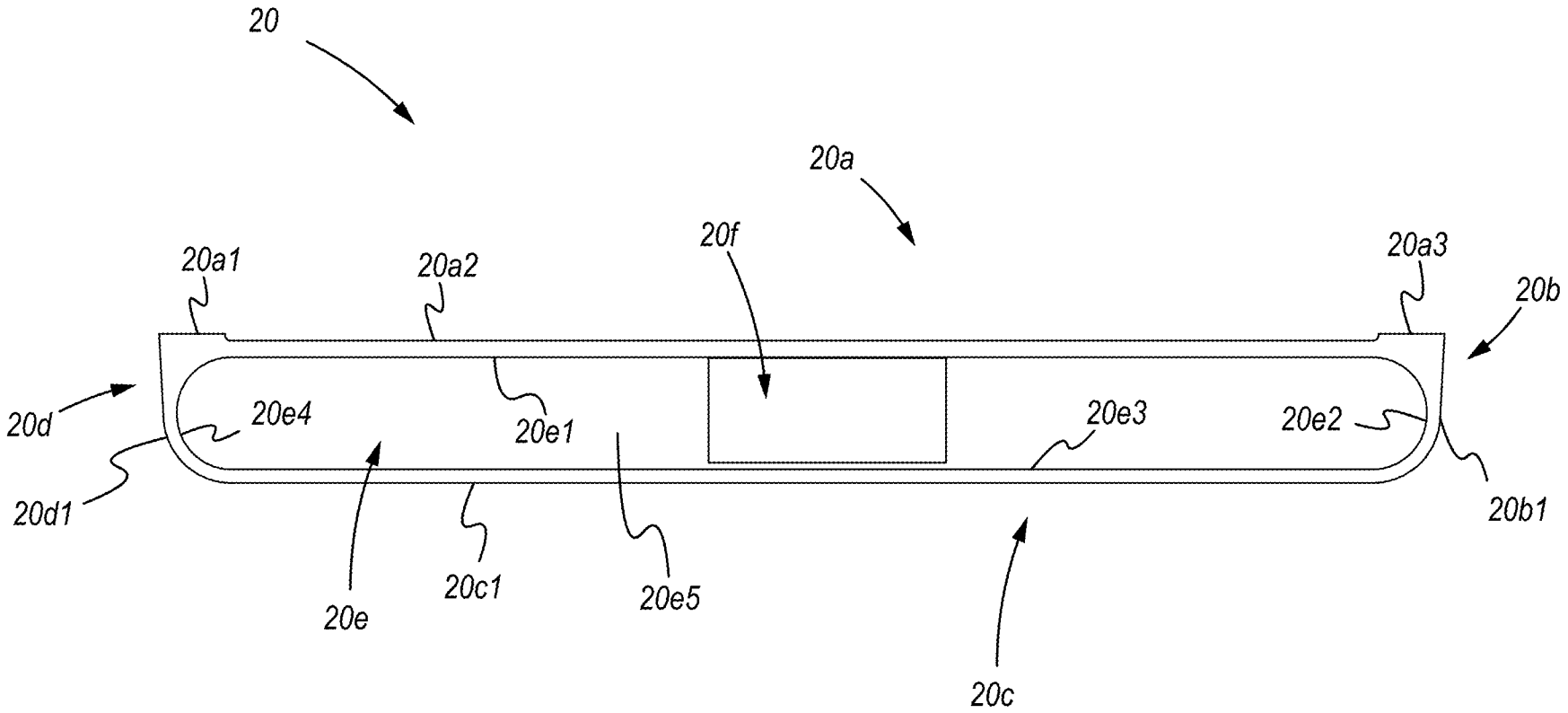
FIG. 9 is a top plan view of a holder assembly.

Turning to FIG. 9, depicted therein is a top plan view of holder assembly 20 including front wall portion 20*a* with ridge portions 20*a*1, 20*a*2, and 20*a*3, end wall portion 20*b* with outer portion 20*b*1, back wall portion 20*c* with outer portion 20*c*1, end wall portion 20*d* with outer portion 20*d*1, trough region 20*e* with inner portions 20*e*1, 20*e*2, 20*e*3, 20*e*4, and base portion 20*e*5, and retention member 20*f*. In implementations, the ridge portions can guide and align a stylus during insertion and enhance structural stiffness of the front wall portion. The trough region may be dimensioned to receive a stylus, pen, or pencil of a predetermined diameter and align such an implement parallel to the front wall portion. The retention member may be integrally formed with the trough region or include an elastomeric or resilient material to facilitate repeated insertion and removal of the stylus, pen, or pencil while maintaining secure retention.

Figure 10:
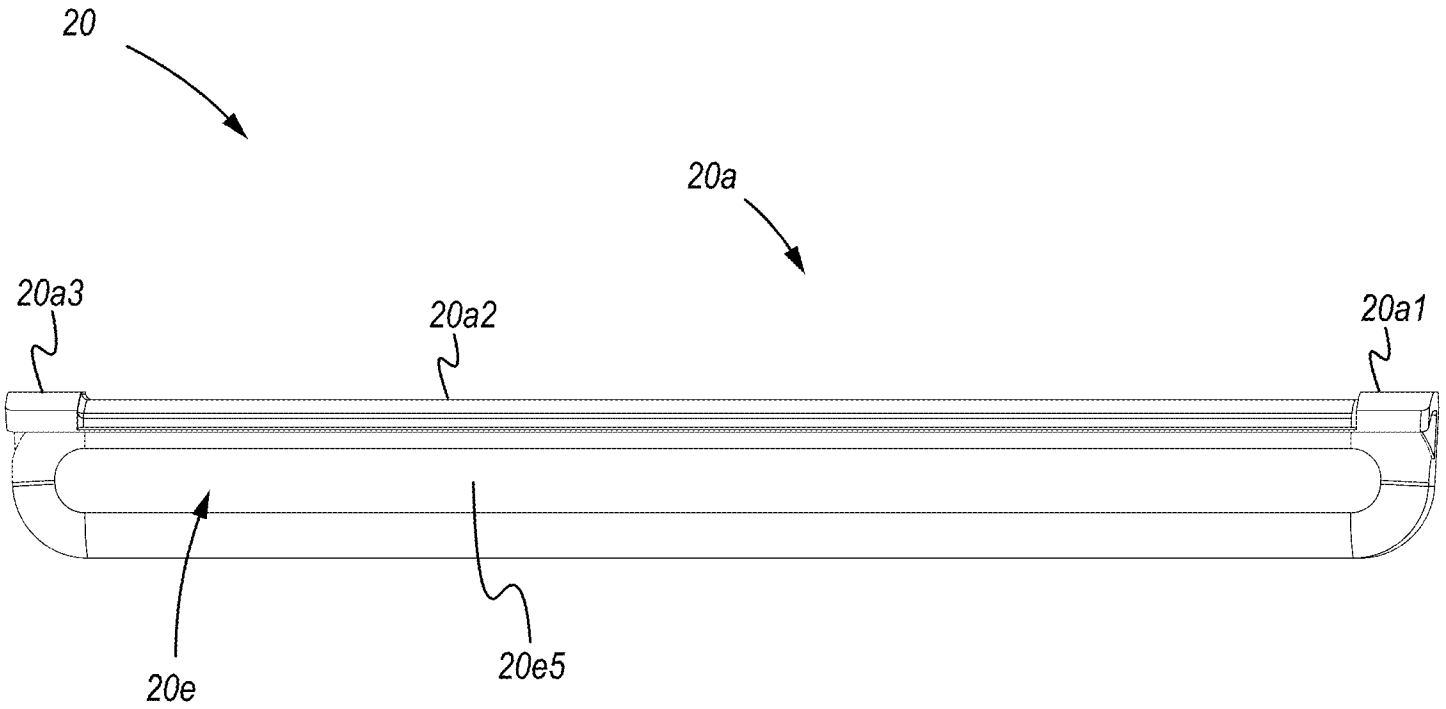
FIG. 10 is a bottom plan view of the holder assembly of FIG. 9.

Turning to FIG. 10, depicted therein is a bottom plan view of holder assembly 20. The configuration of the bottom surface can provide engagement features for coupling with the frame assembly and contribute to defining a continuous outer surface when assembled.

Figure 11:
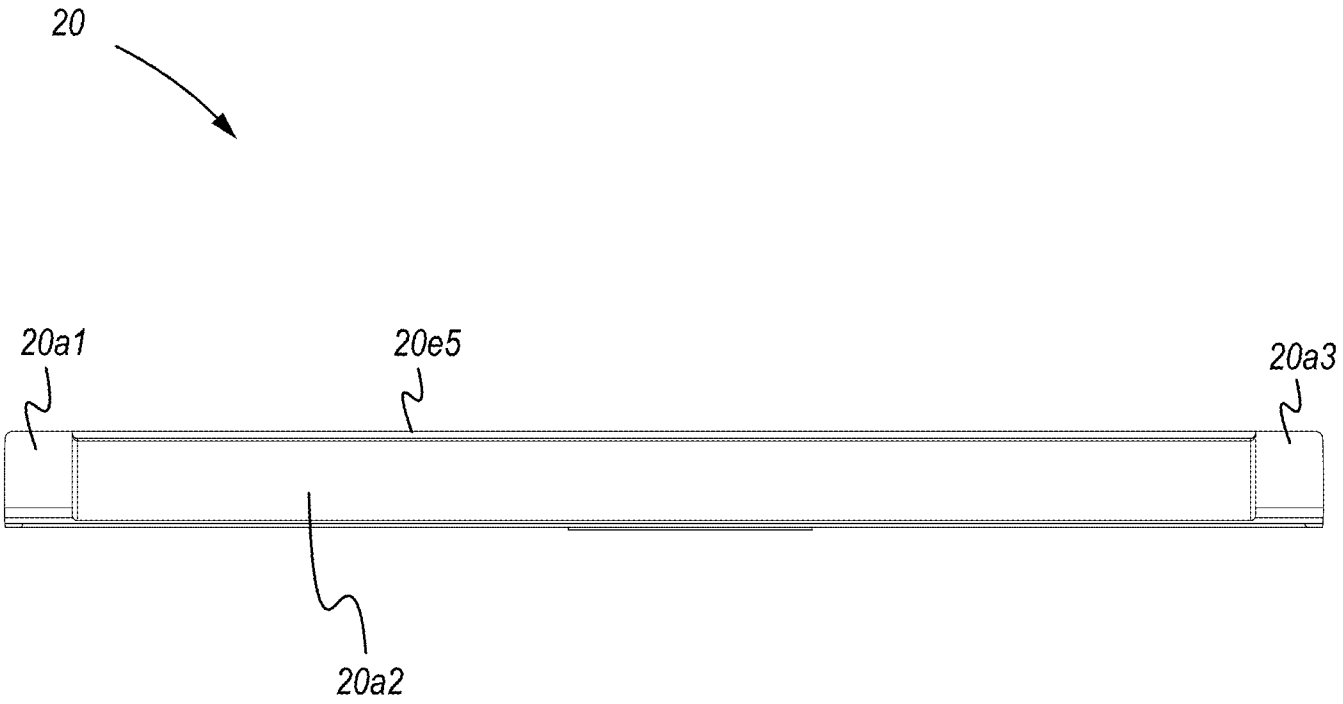
FIG. 11 is a left side elevational view of the holder assembly of FIG. 9.

Turning to FIG. 11, depicted therein is a left side elevational view of holder assembly 20. The end wall portions and back wall portion can engage corresponding surfaces of the frame assembly to achieve a stable fit without tools.

Figure 12:
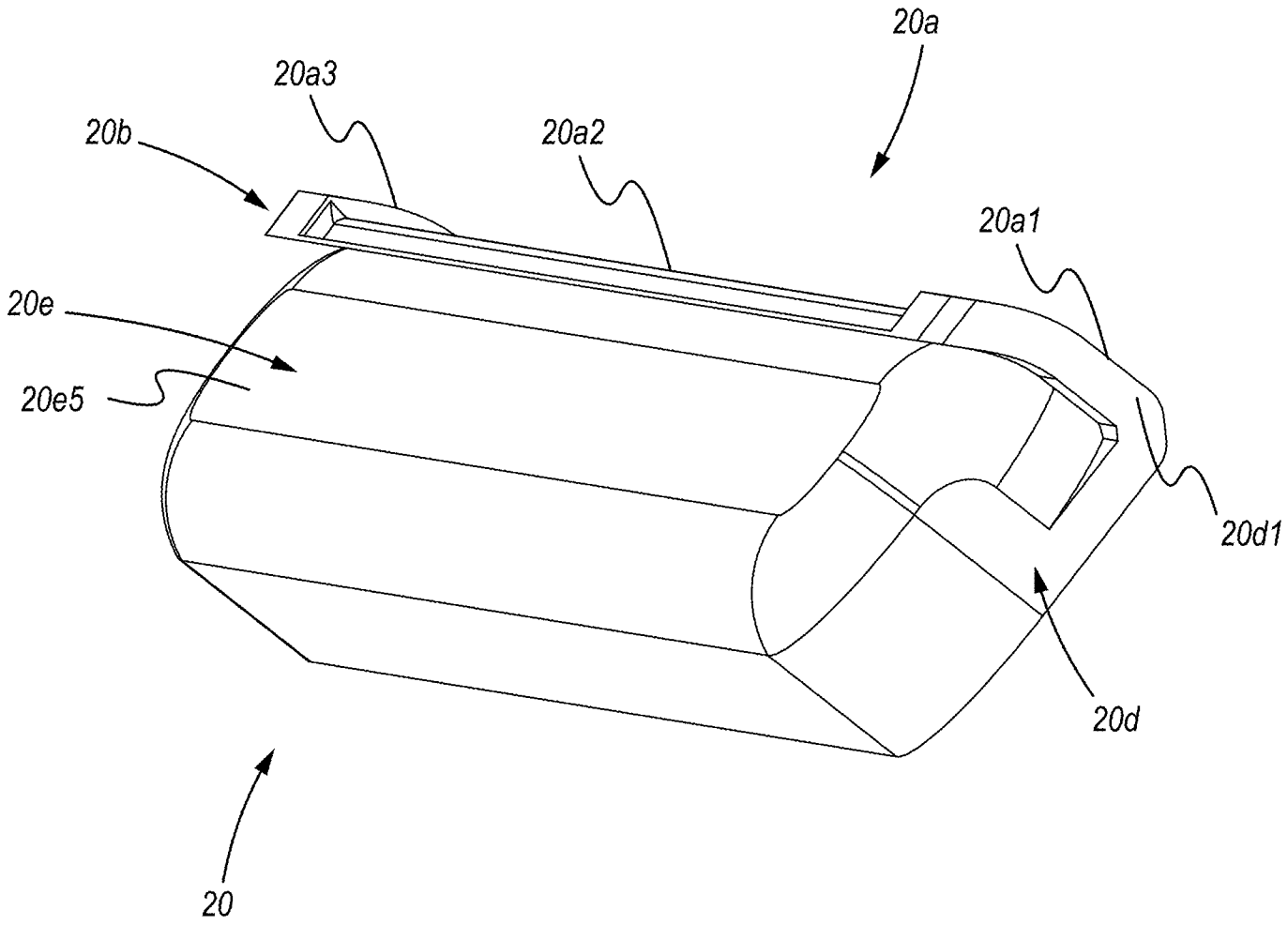
FIG. 12 is a front elevational view of the holder assembly of FIG. 9.

Turning to FIG. 12, depicted therein is a front elevational view of holder assembly 20. In some examples, the ridge portions on the front wall portion may also function to increase the stiffness of the overall holder structure.

Figure 13:
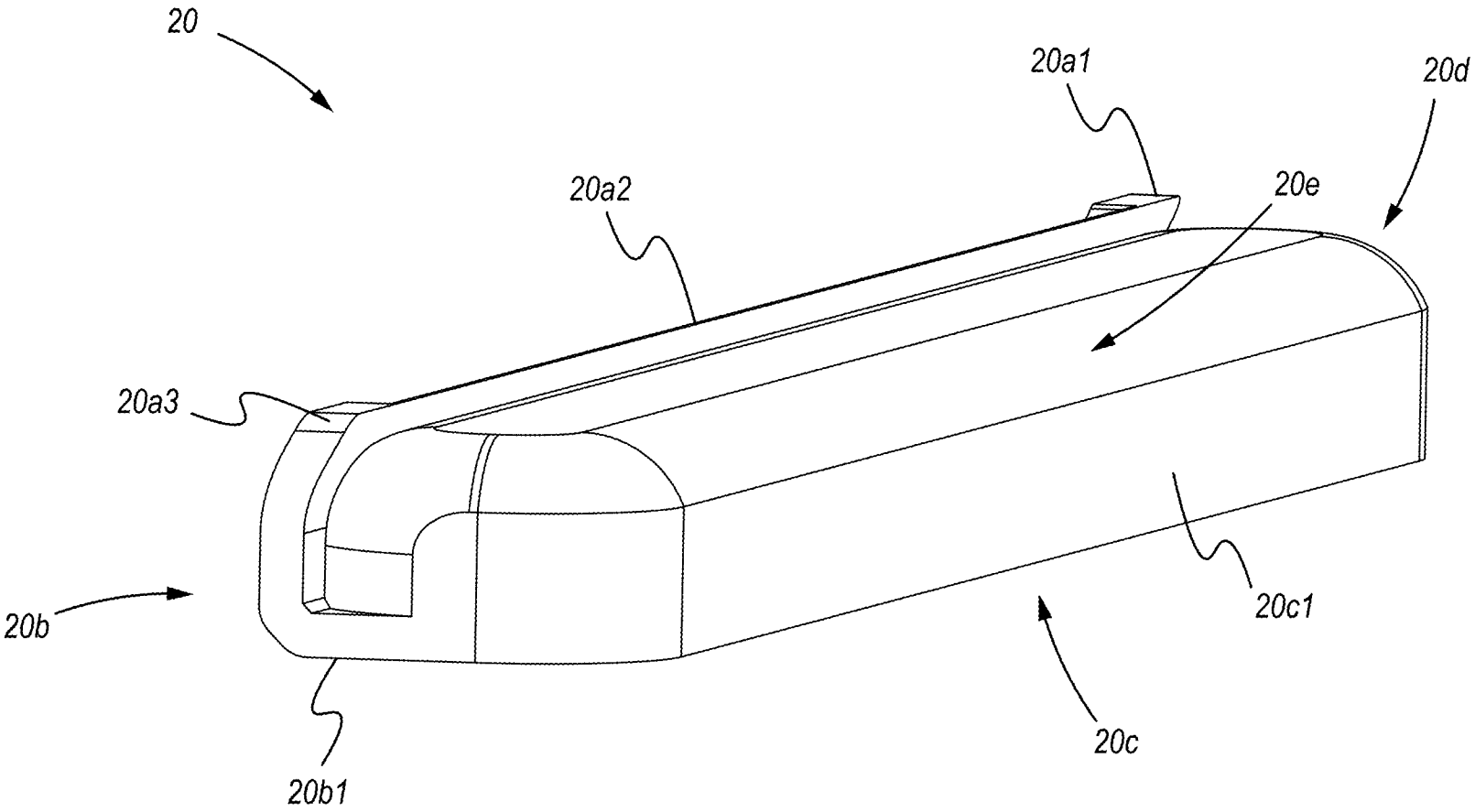
FIG. 13 is a rear elevational view of the holder assembly of FIG. 9.

Turning to FIG. 13, depicted therein is a rear elevational view of holder assembly 20.

Figure 14:
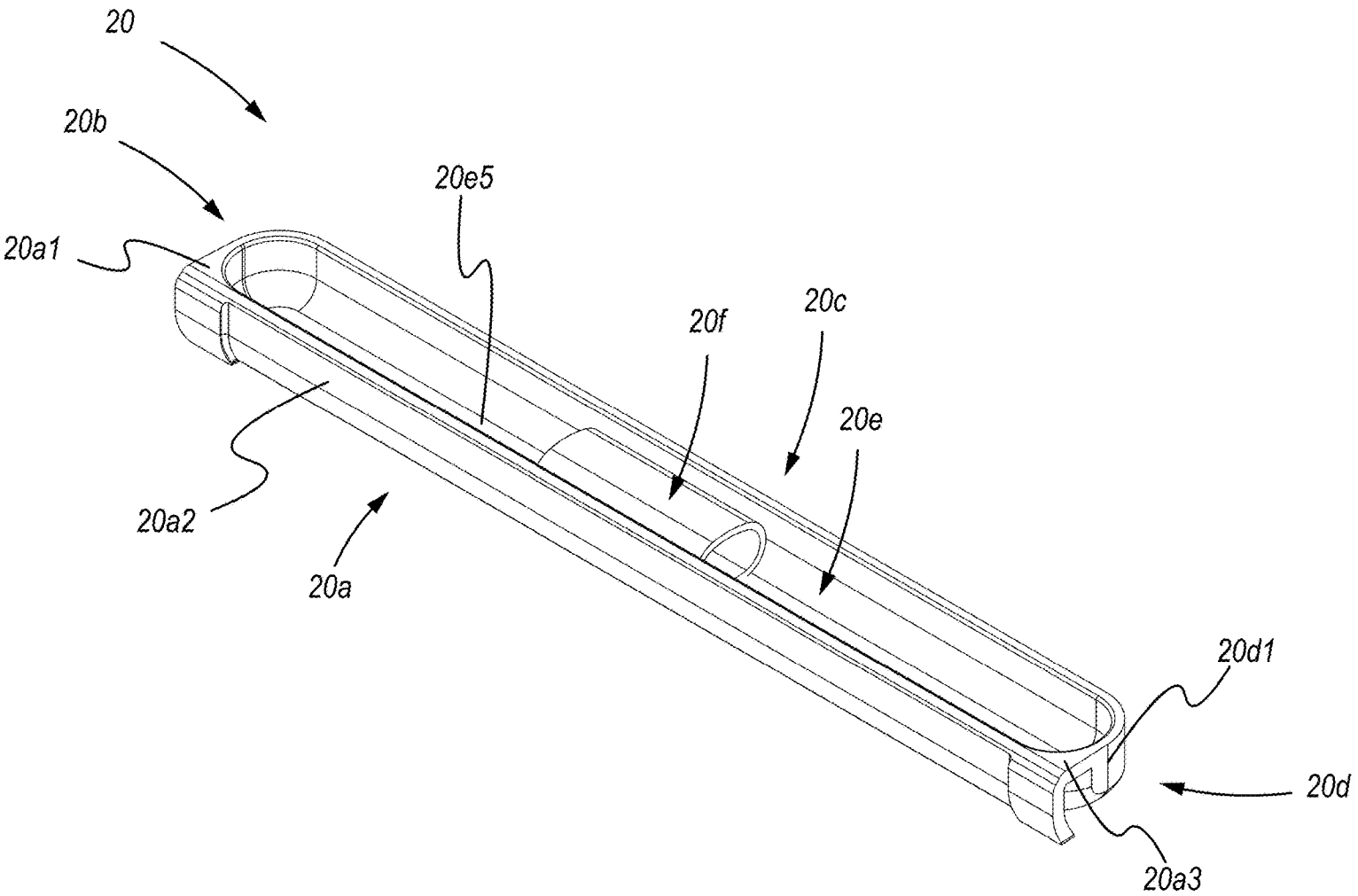
FIG. 14 is a right front top perspective view of the holder assembly of FIG. 9.

Turning to FIG. 14, depicted therein is a right front top perspective view of holder assembly 20.

Figure 15:
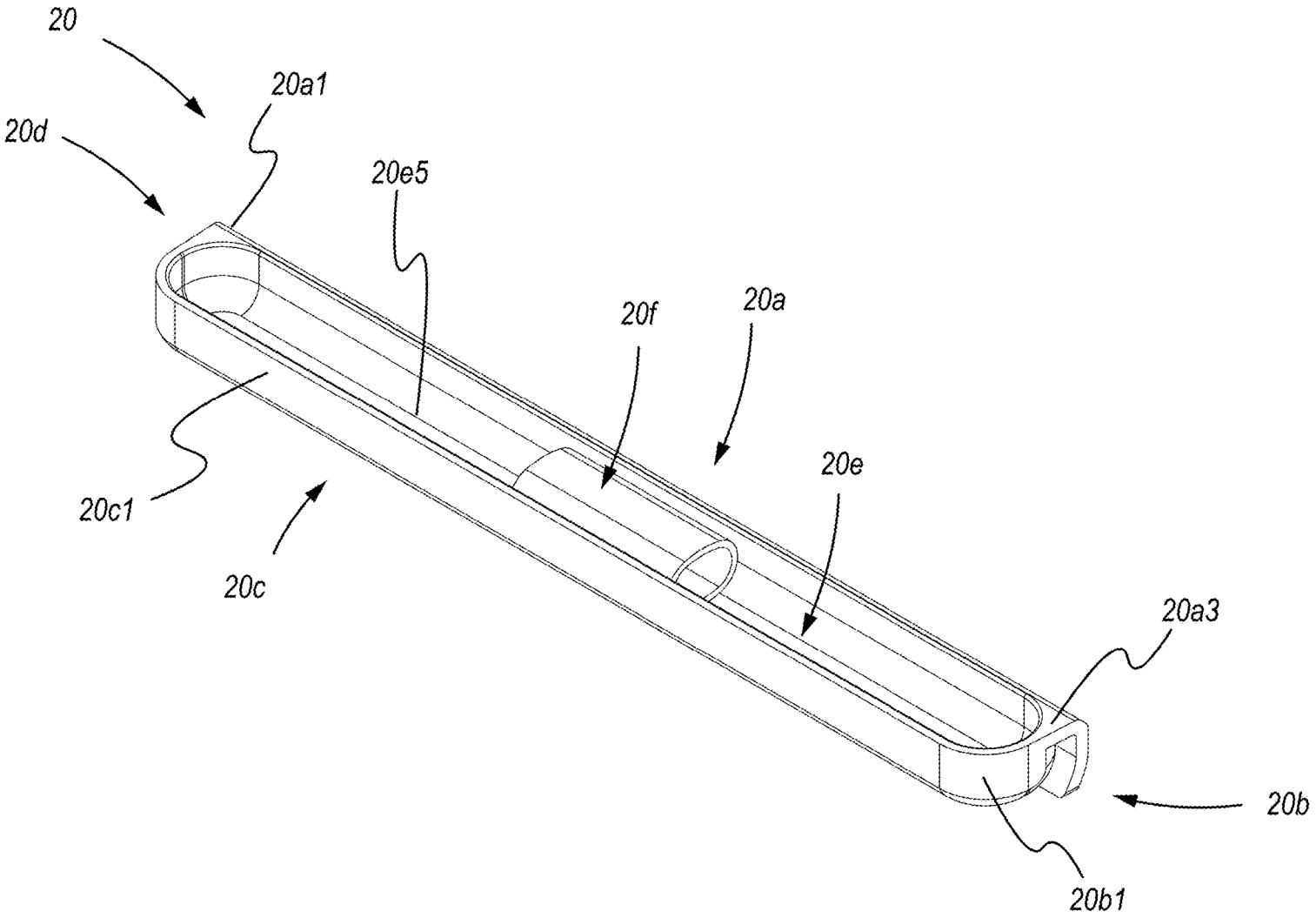
FIG. 15 is a left back top perspective view of the holder assembly of FIG. 9.

Turning to FIG. 15, depicted therein is a left back top perspective view of holder assembly 20.

Figure 16:
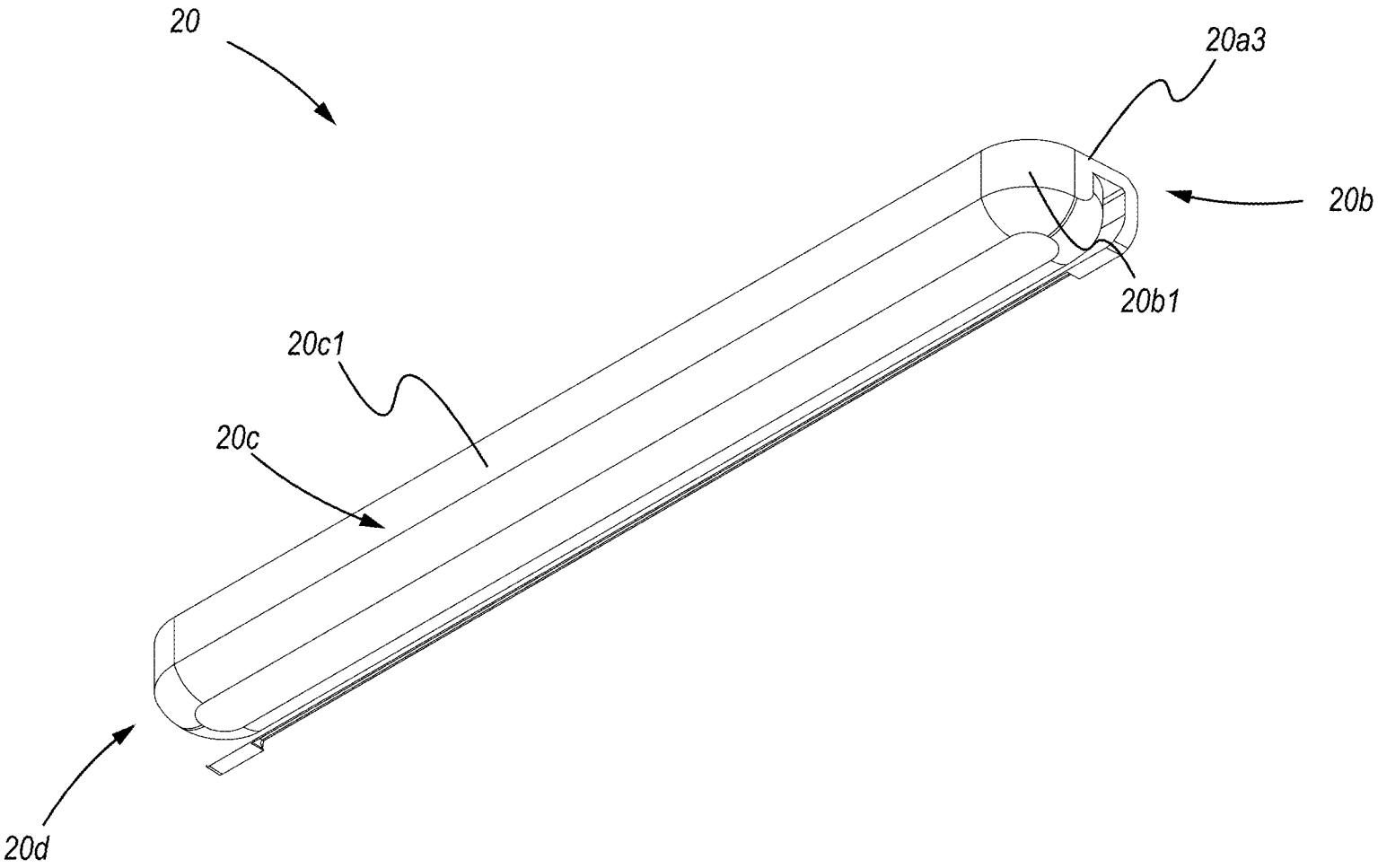
FIG. 16 is a left back bottom perspective view of the holder assembly of FIG. 9.

Turning to FIG. 16, depicted therein is a left back bottom perspective view of holder assembly 20.

Figure 17:
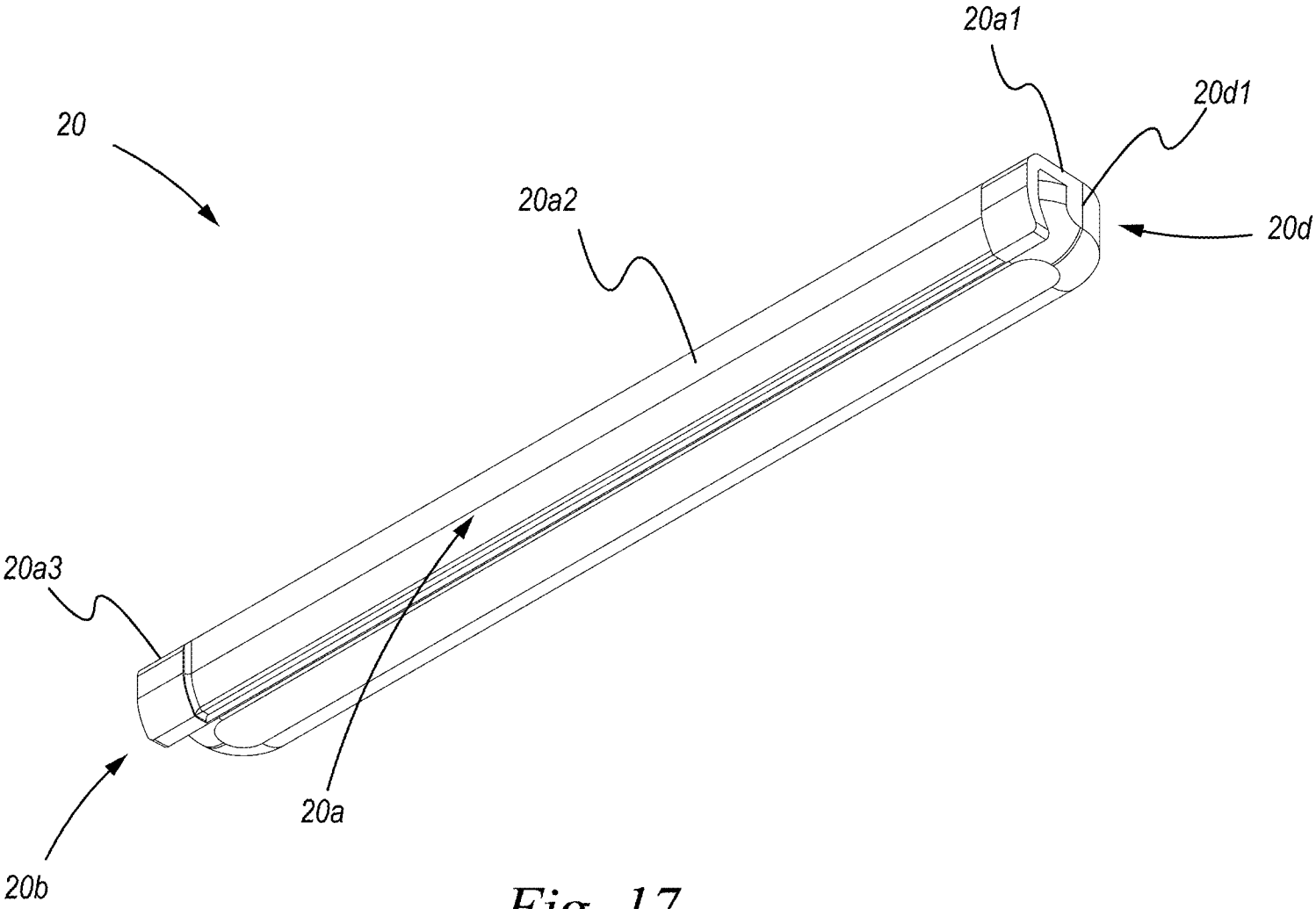
FIG. 17 is a right front bottom perspective view of the holder assembly of FIG. 9.

Turning to FIG. 17, depicted therein is a right front bottom perspective view of holder assembly 20.

Figure 18:
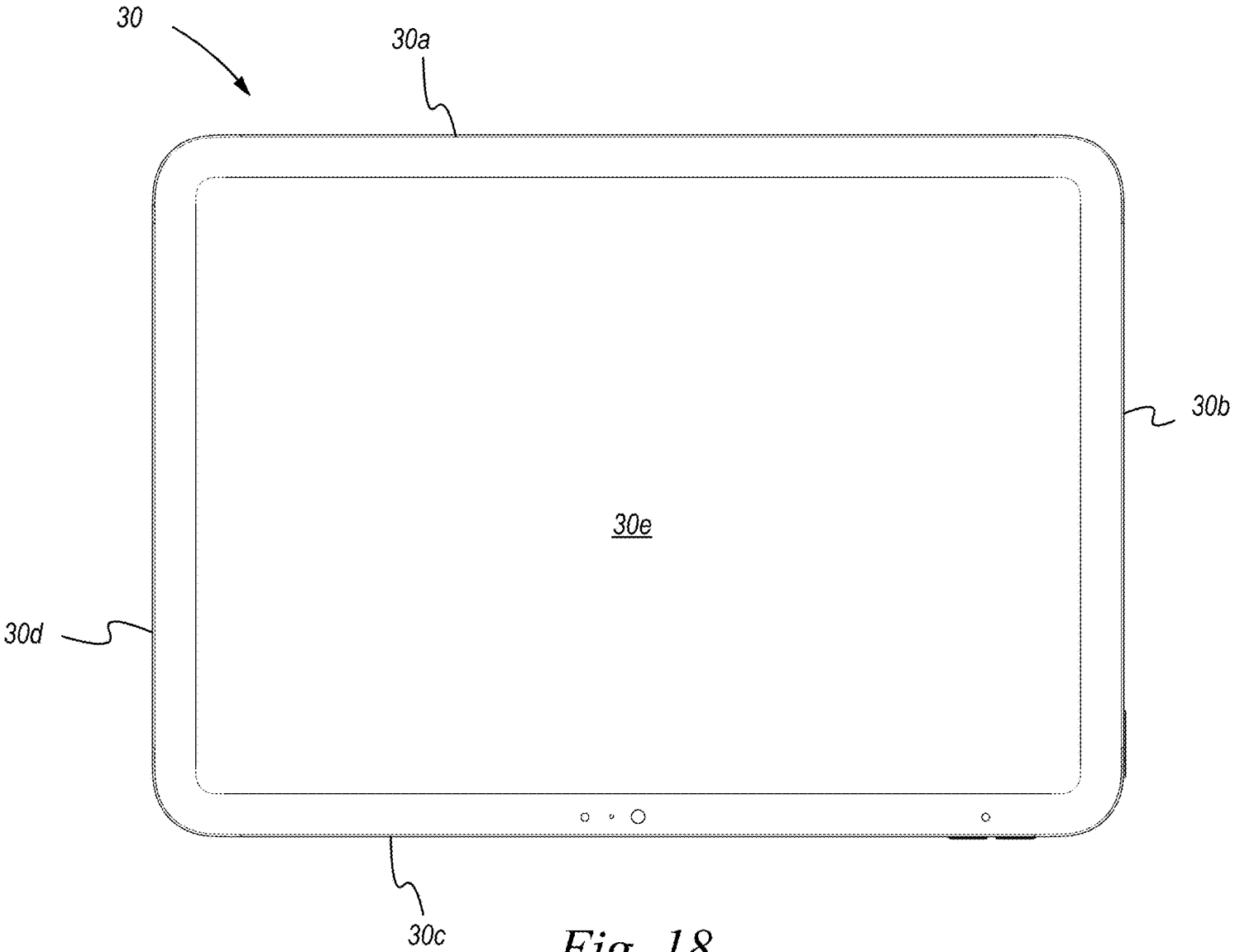
FIG. 18 is a top plan view of a portable electronic device.

Turning to FIG. 18, depicted therein is a top plan view of portable electronic device 30 including side 30*a*, side 30*b*, side 30*c*, side 30*d*, and display 30*e*. The display can be configured to interface with a conductive tip of a stylus, pen, or pencil stored in the holder assembly.

Figure 19:
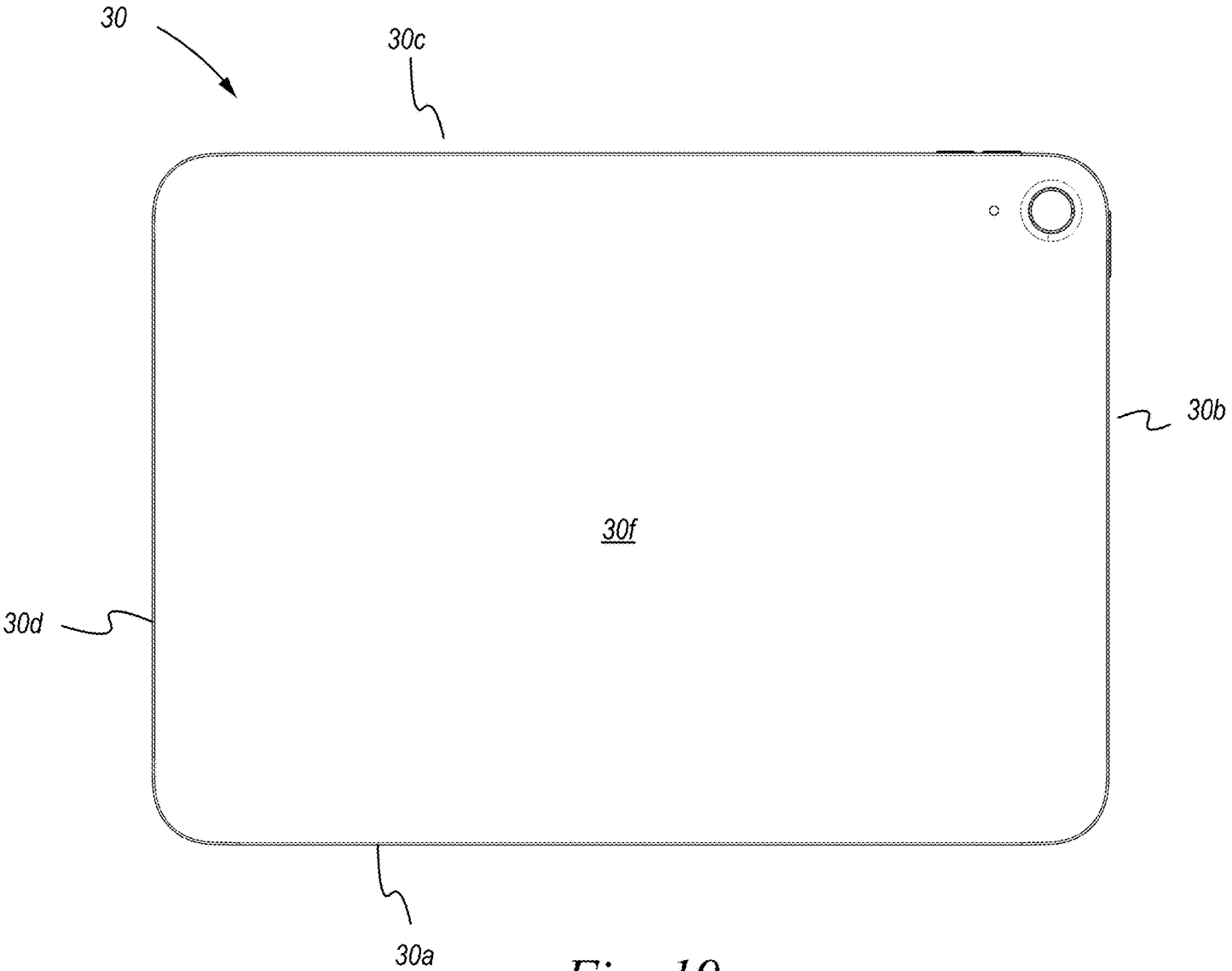
FIG. 19 is a bottom plan view of the portable electronic device of FIG. 18.

Turning to FIG. 19, depicted therein is a bottom plan view of portable electronic device 30 including back 30*f*.

Figure 20:
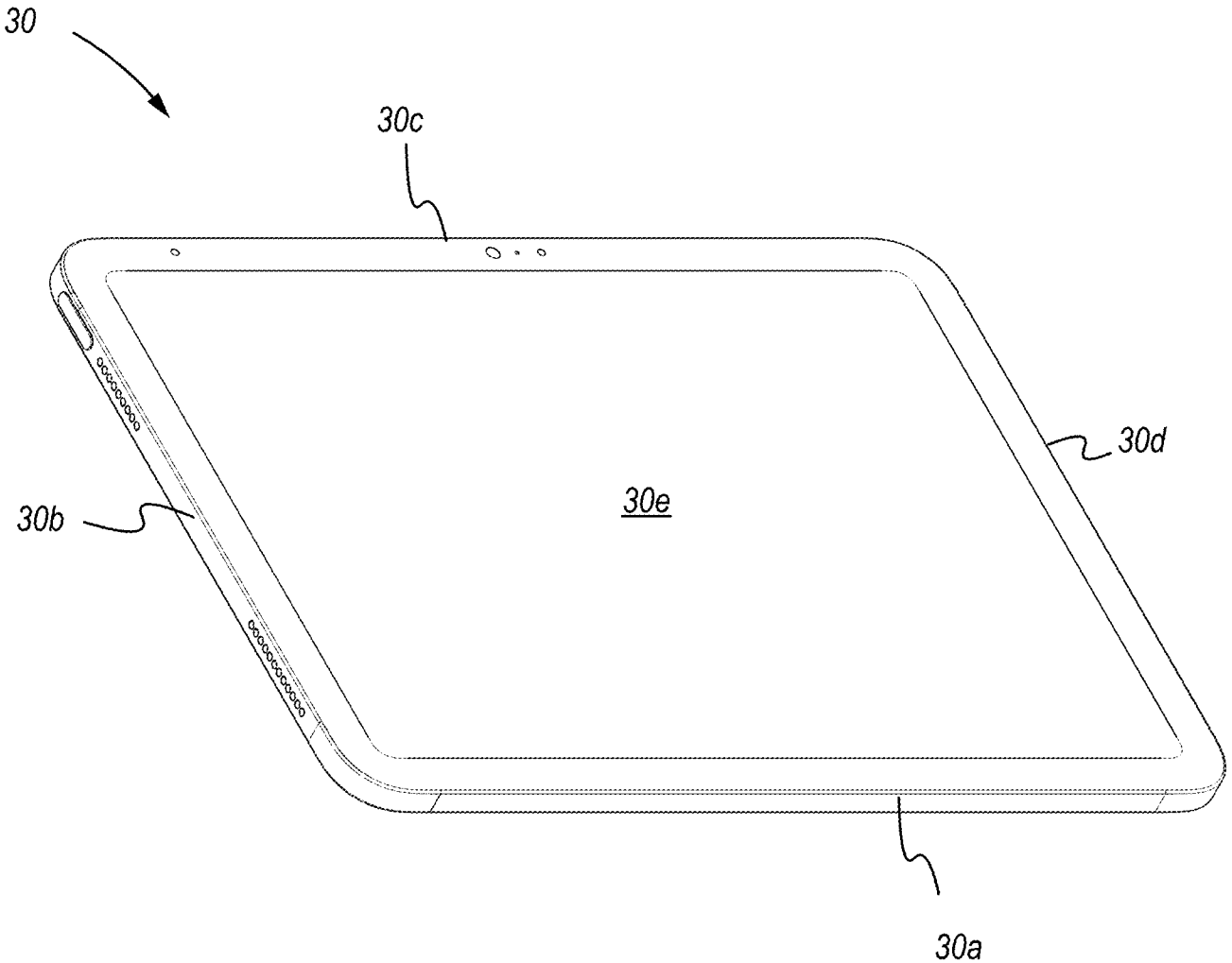
FIG. 20 is a right front top perspective view of the portable electronic device of FIG. 18.

Turning to FIG. 20, depicted therein is a right front top perspective view of portable electronic device 30.

Figure 21:
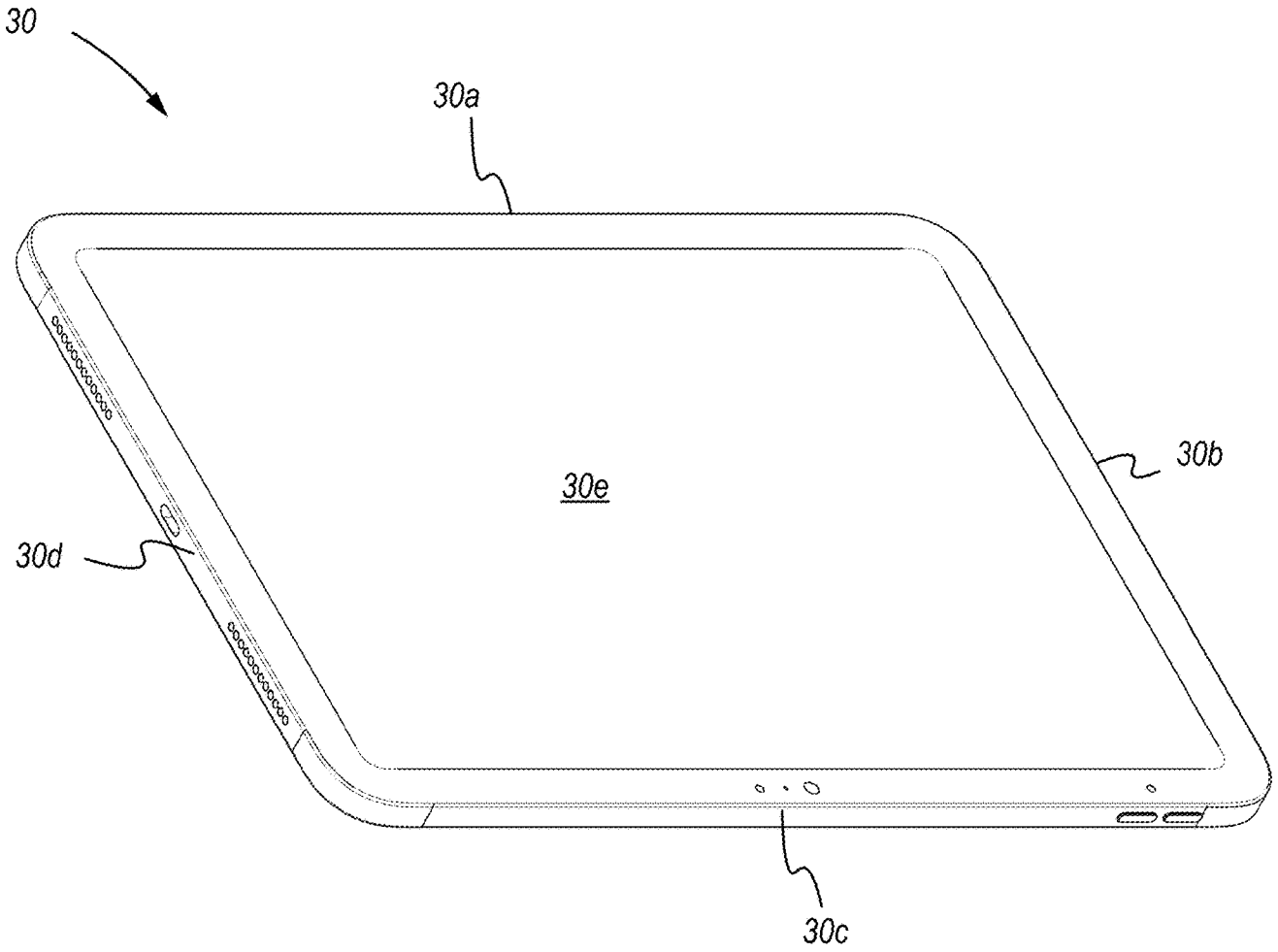
FIG. 21 is a left back top perspective view of the portable electronic device of FIG. 18.

Turning to FIG. 21, depicted therein is a left back top perspective view of portable electronic device 30.

Figure 22:
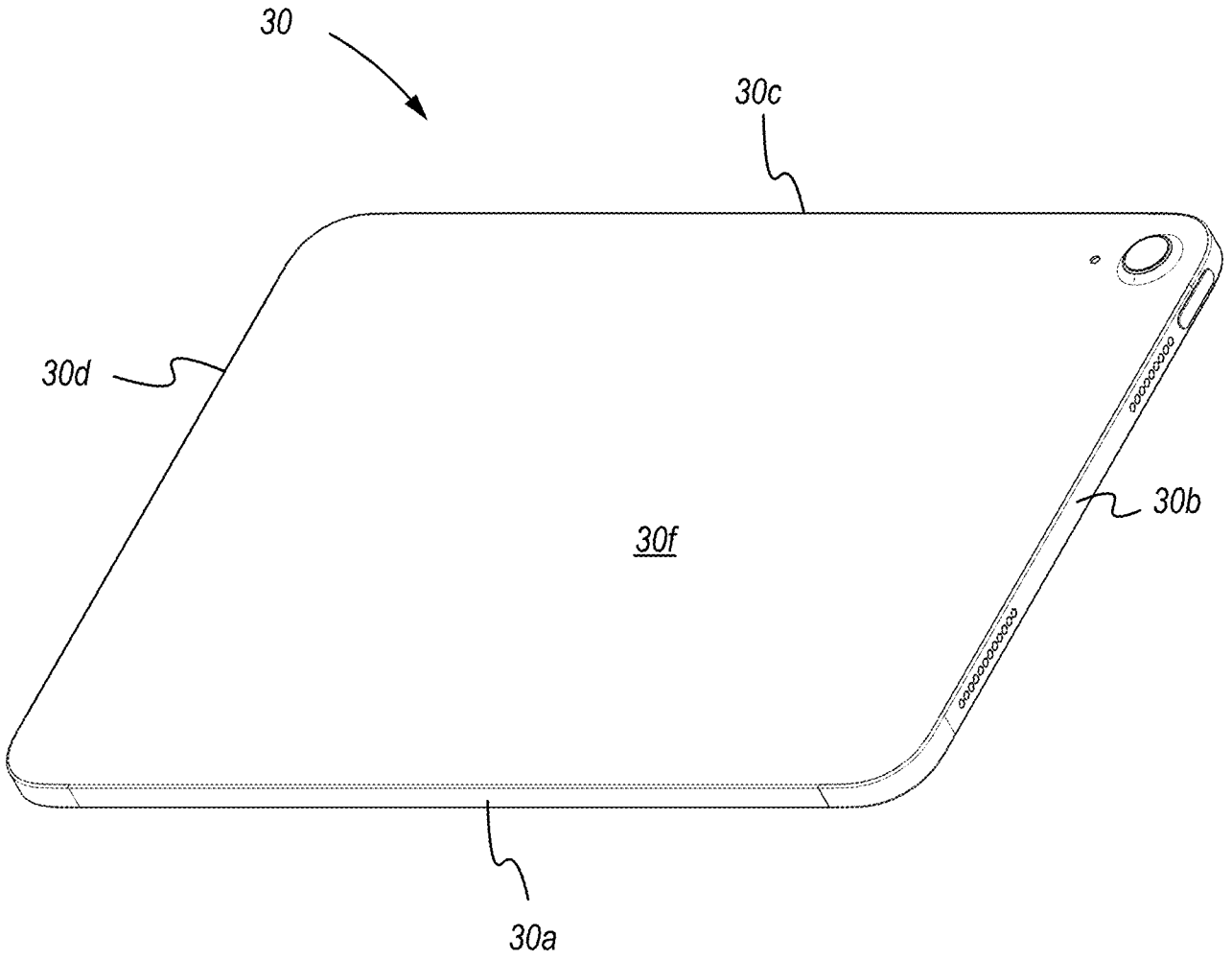
FIG. 22 is a left back bottom perspective view of the portable electronic device of FIG. 18.

Turning to FIG. 22, depicted therein is a left back bottom perspective view of portable electronic device 30.

Figure 23:
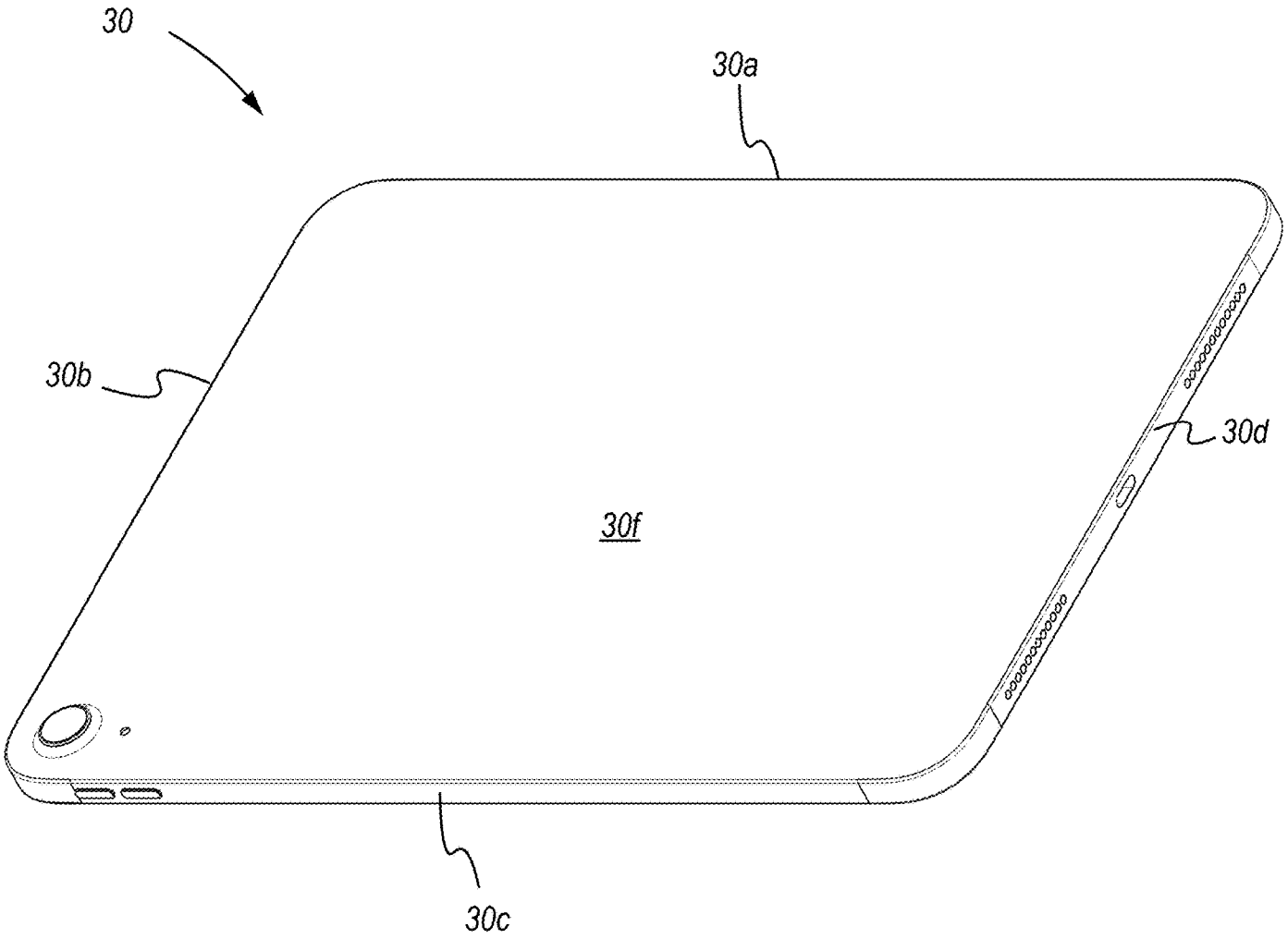
FIG. 23 is a right front bottom perspective view of the portable electronic device of FIG. 18.

Turning to FIG. 23, depicted therein is a right front bottom perspective view of portable electronic device 30.

Figure 24:
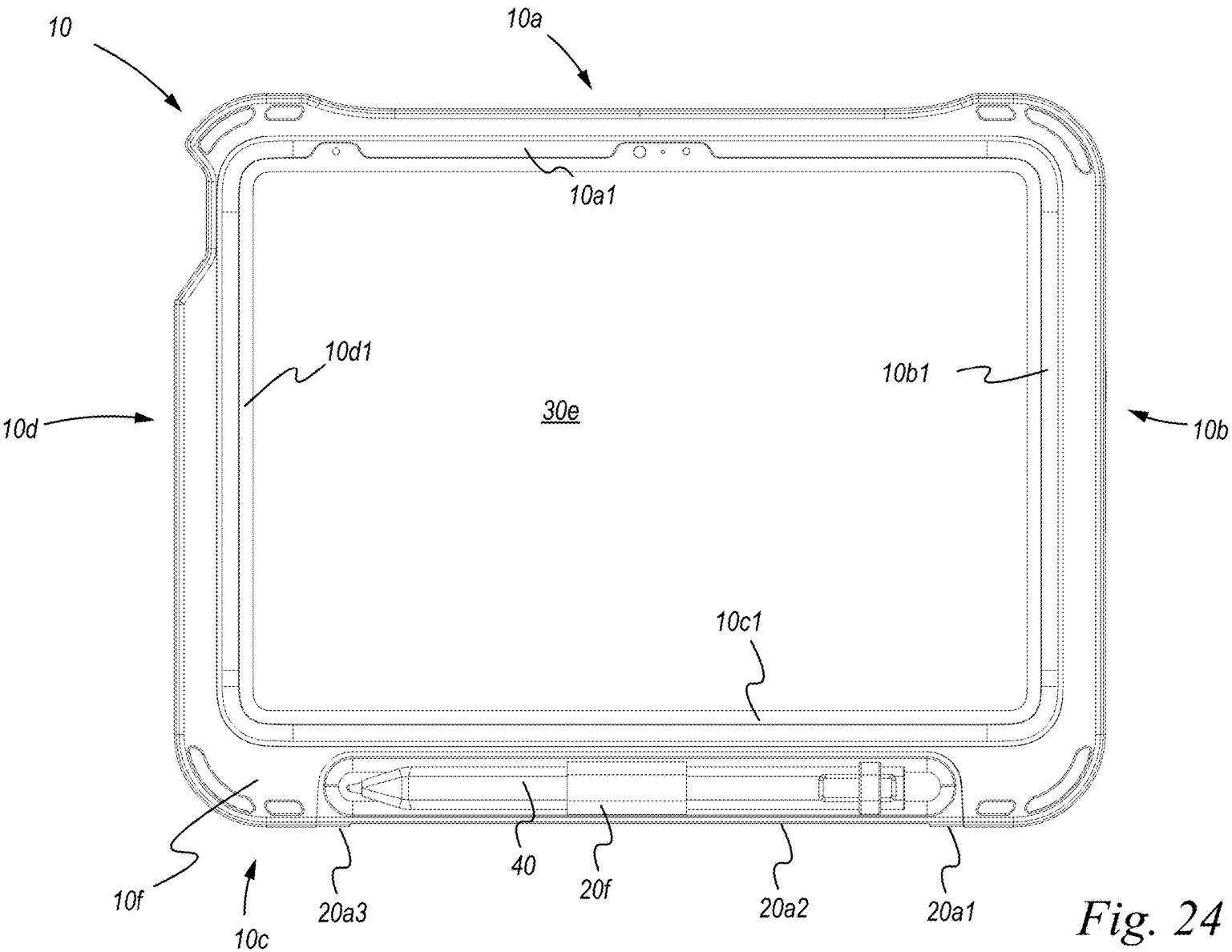
FIG. 24 is a top plan view of the assembly including the frame assembly, holder assembly, and portable electronic device, excluding the back side.

Turning to FIG. 24, depicted therein is a top plan view of the assembly including frame assembly 10, holder assembly 20, portable electronic device 30, and stylus 40. In examples, the holder assembly may be detachably coupled to the frame assembly without tools, allowing the stylus, pen, or pencil to be stored and retrieved conveniently. When assembled, the frame assembly and holder assembly may define a continuous exterior surface. The stylus, pen, or pencil may include a conductive tip for operating the portable electronic device display.

Figure 25:
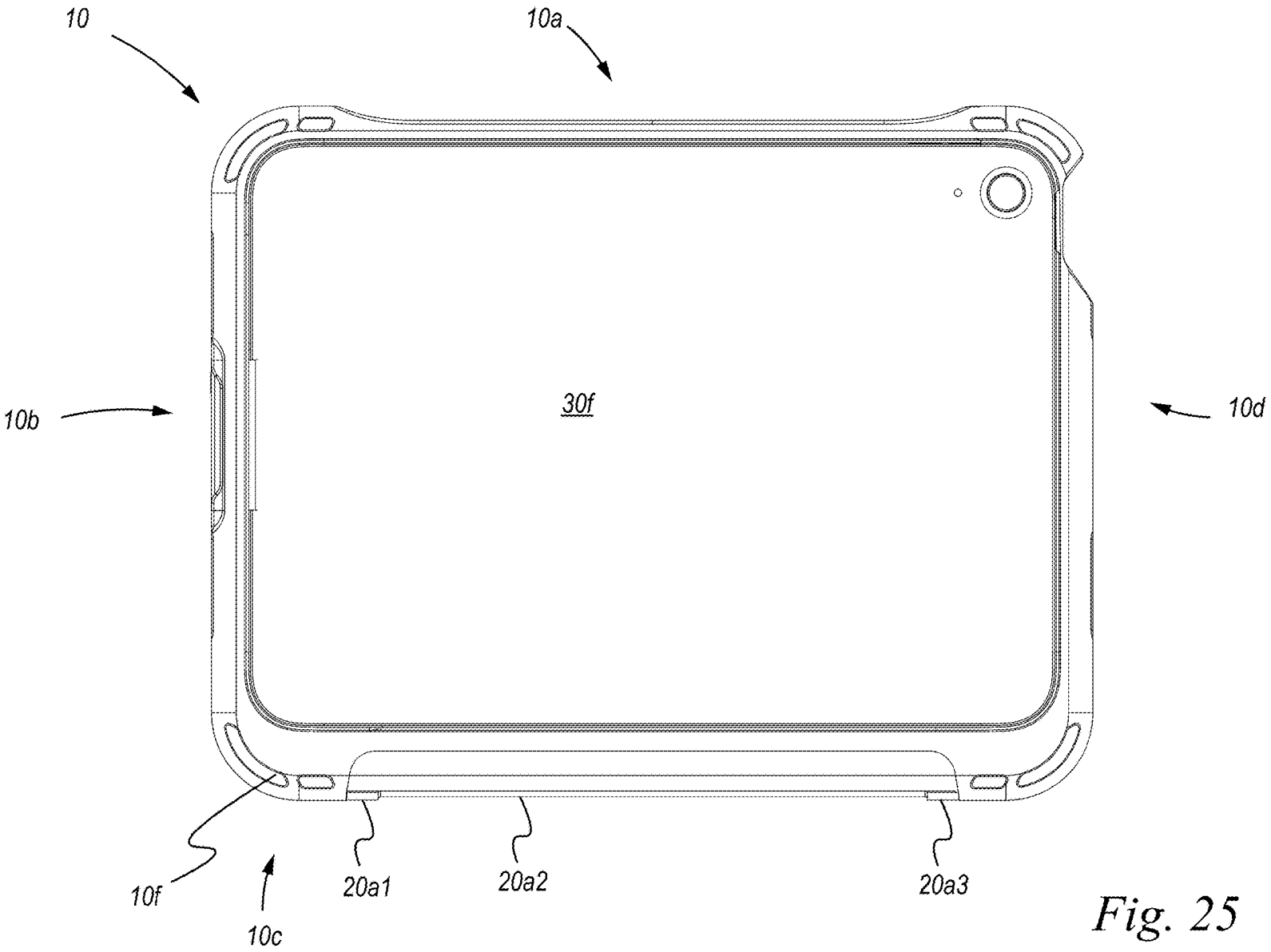
FIG. 25 is a bottom plan view of the assembly of FIG. 24.

Turning to FIG. 25, depicted therein is a bottom plan view of the assembly of FIG. 24.

Figure 26:
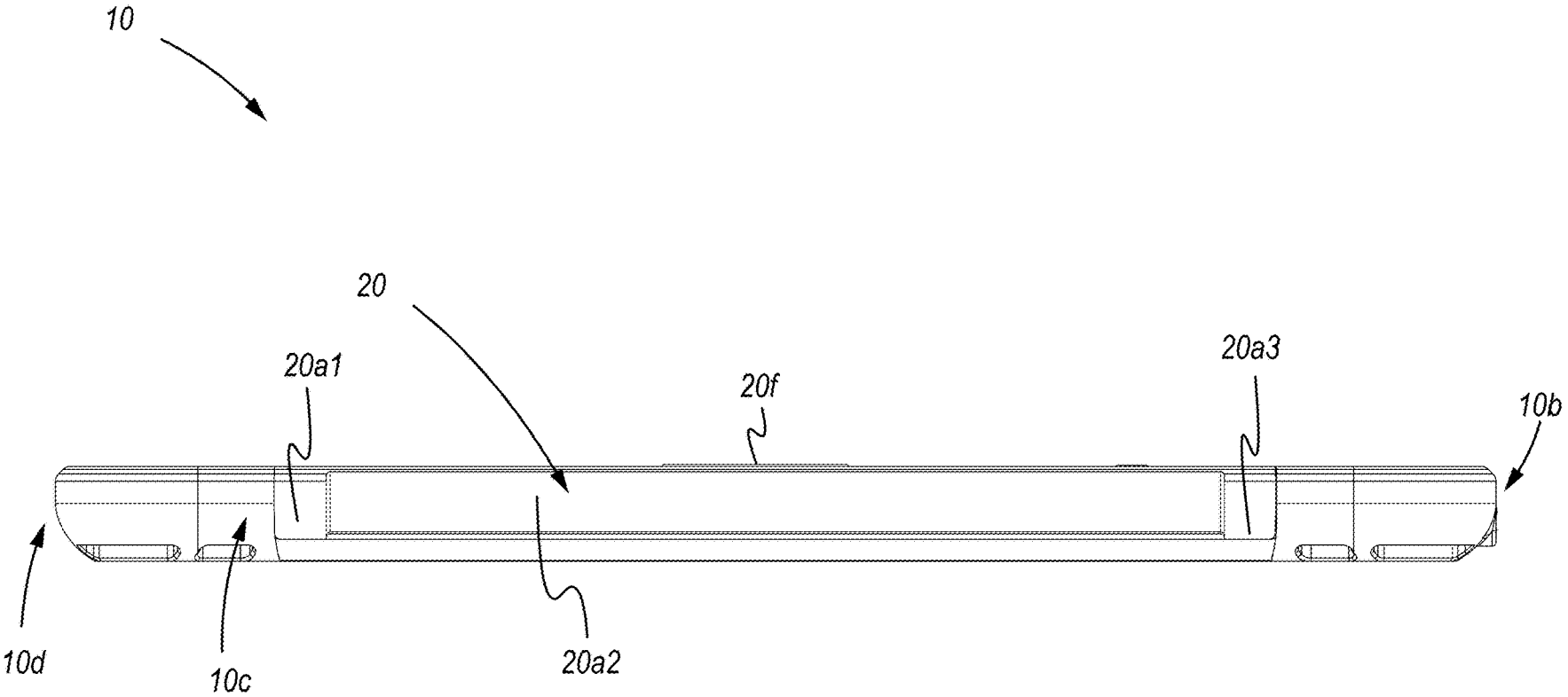
FIG. 26 is a left side elevational view of the assembly of FIG. 24.

Turning to FIG. 26, depicted therein is a left side elevational view of the assembly of FIG. 24.

Figure 27:
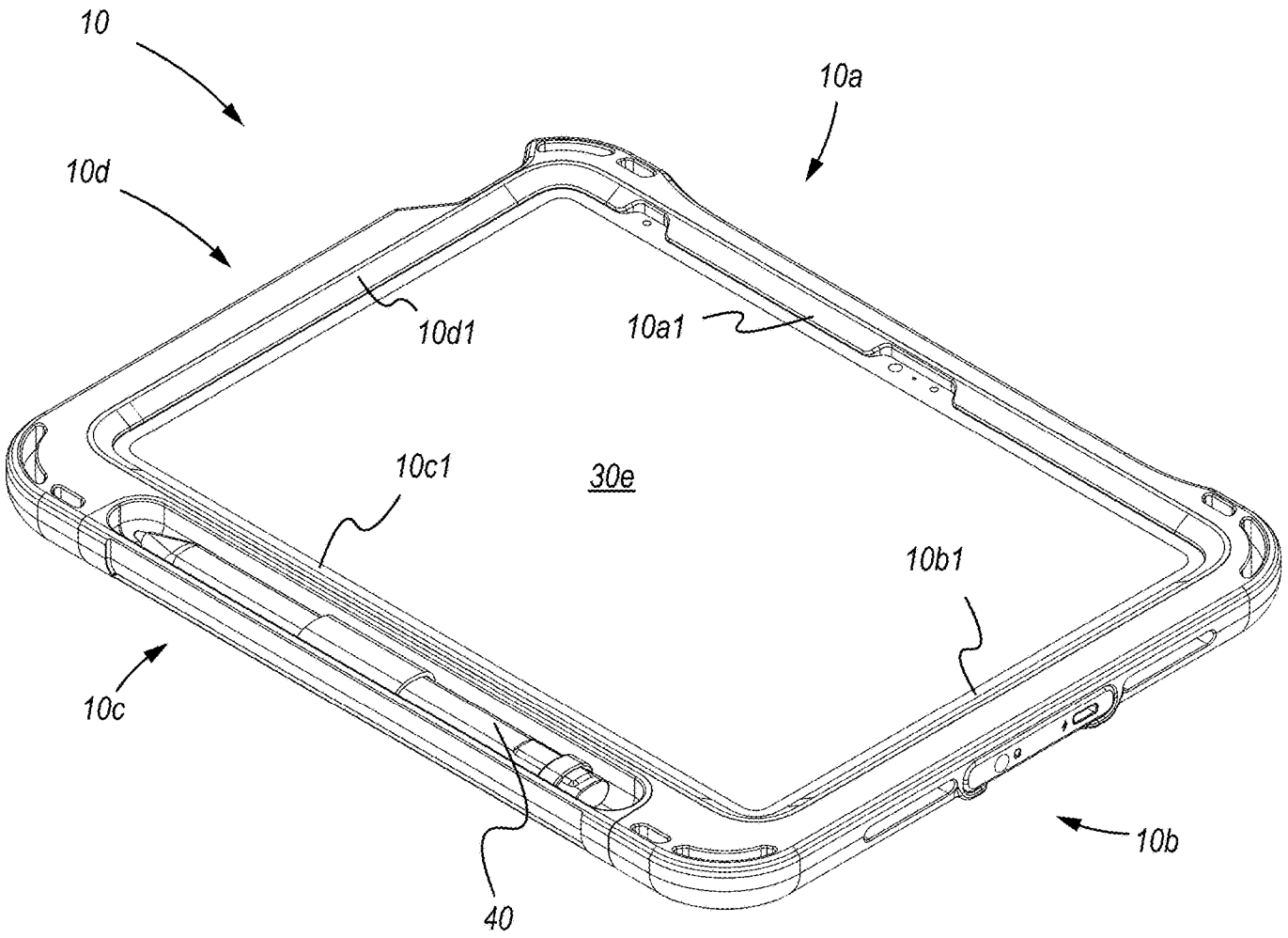
FIG. 27 is a right front top perspective view of the assembly of FIG. 24.

Turning to FIG. 27, depicted therein is a right front top perspective view of the assembly of FIG. 24.

Figure 28:
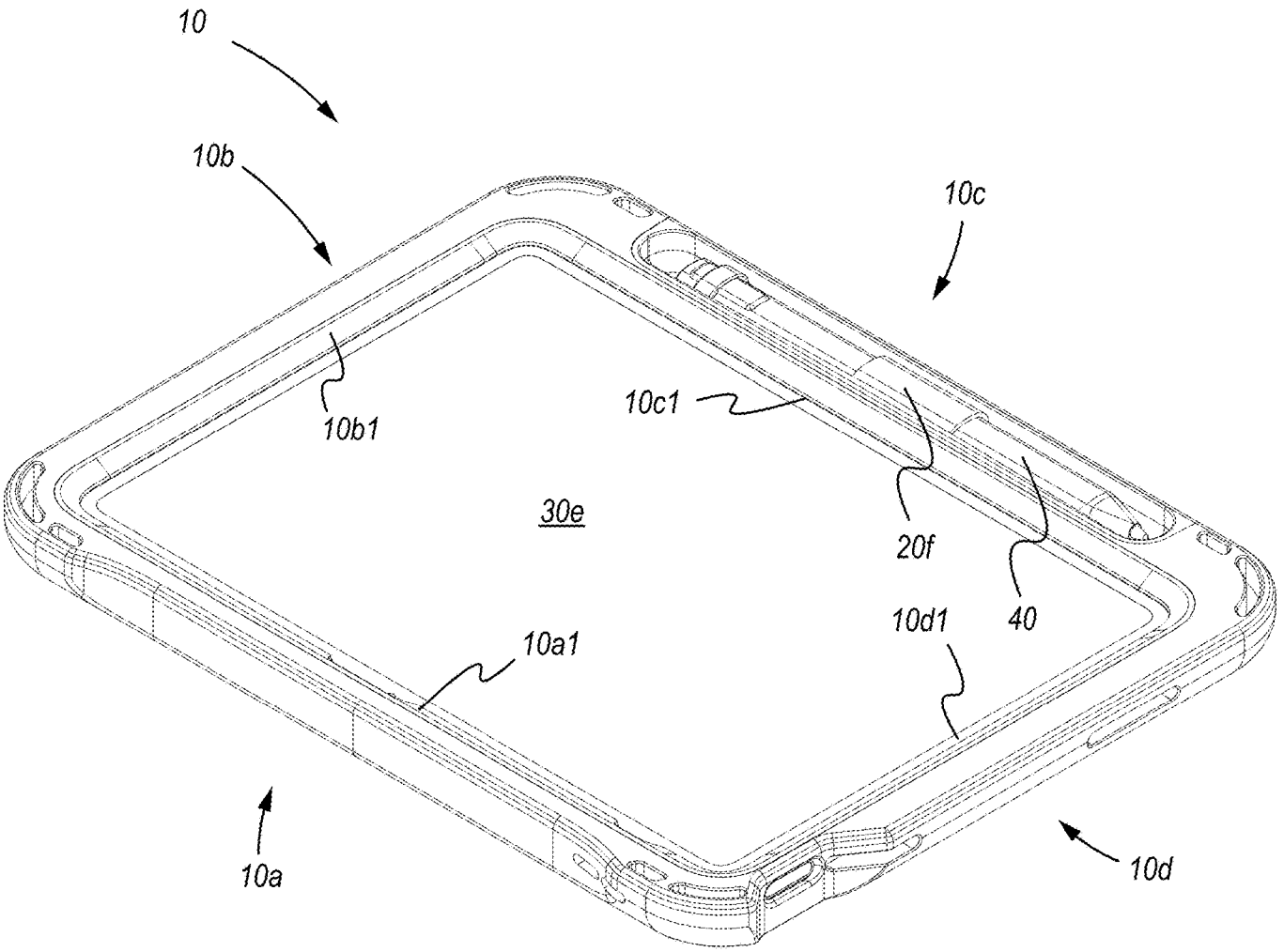
FIG. 28 is a left back top perspective view of the assembly of FIG. 24.

Turning to FIG. 28, depicted therein is a left back top perspective view of the assembly of FIG. 24.

Figure 29:
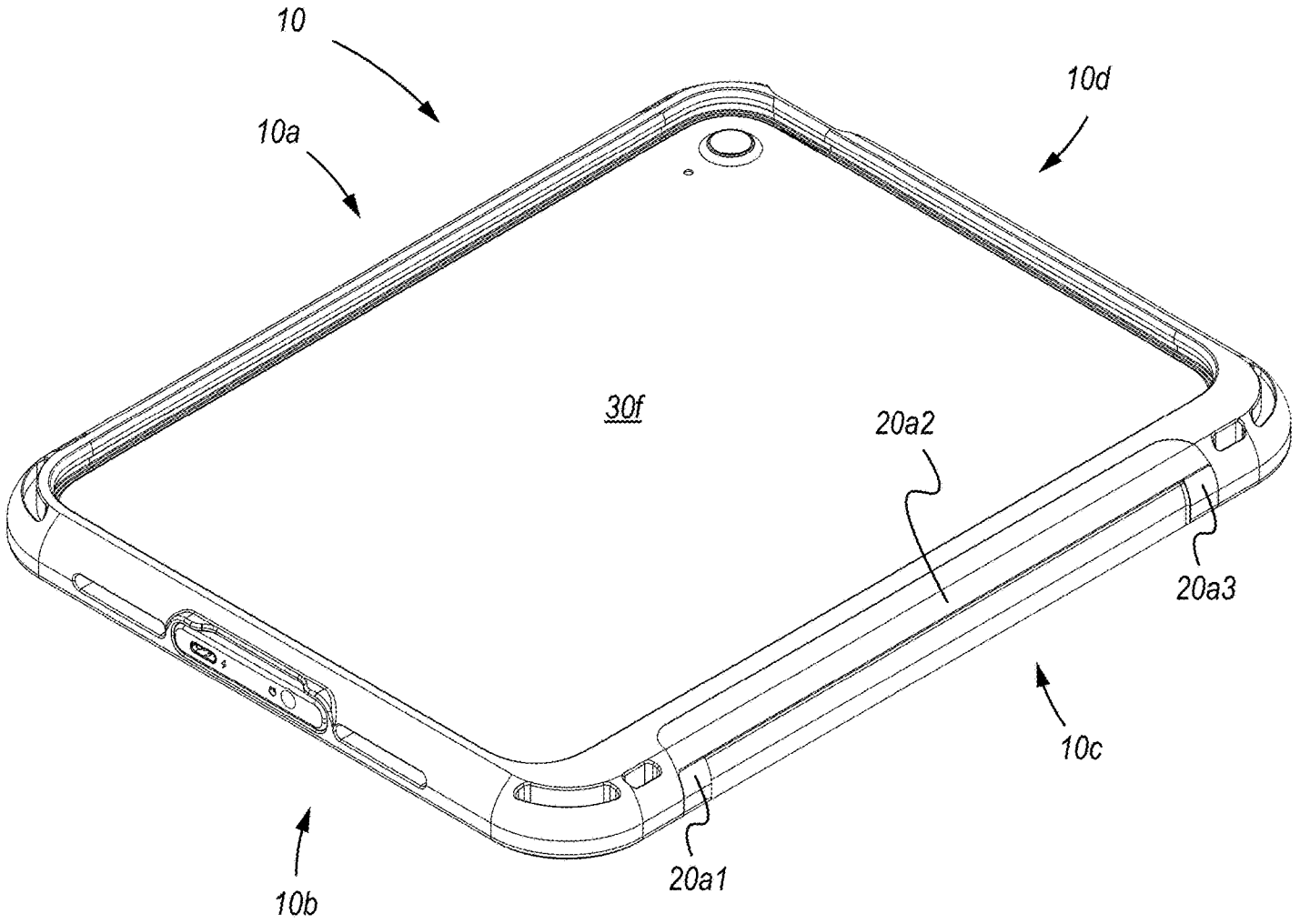
FIG. 29 is a left back bottom perspective view of the assembly of FIG. 24.

Turning to FIG. 29, depicted therein is a left back bottom perspective view of the assembly of FIG. 24.

Figure 30:
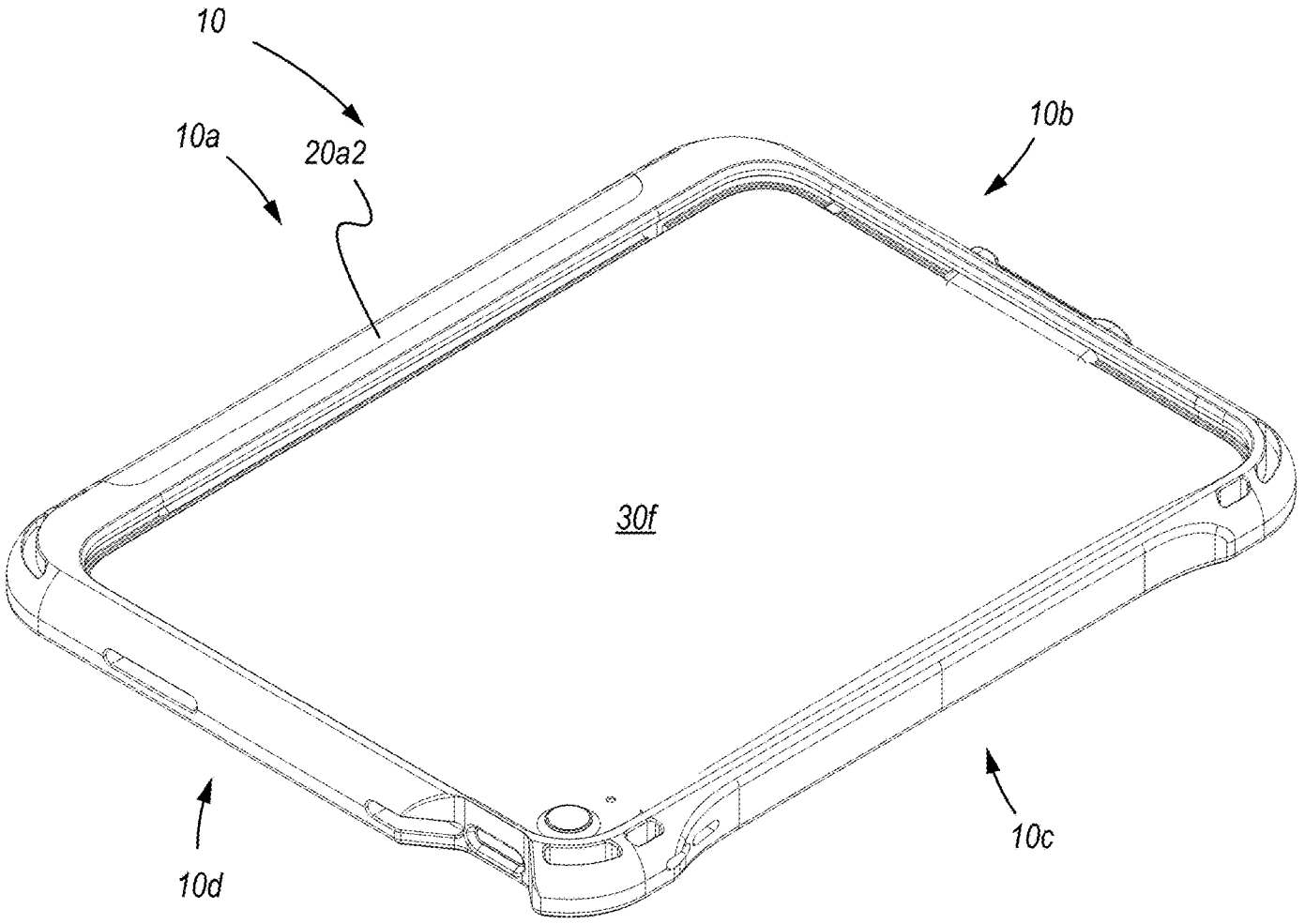
FIG. 30 is a right front bottom perspective view of the assembly of FIG. 24.

Turning to FIG. 30, depicted therein is a right front bottom perspective view of the assembly of FIG. 24.

Figure 31:
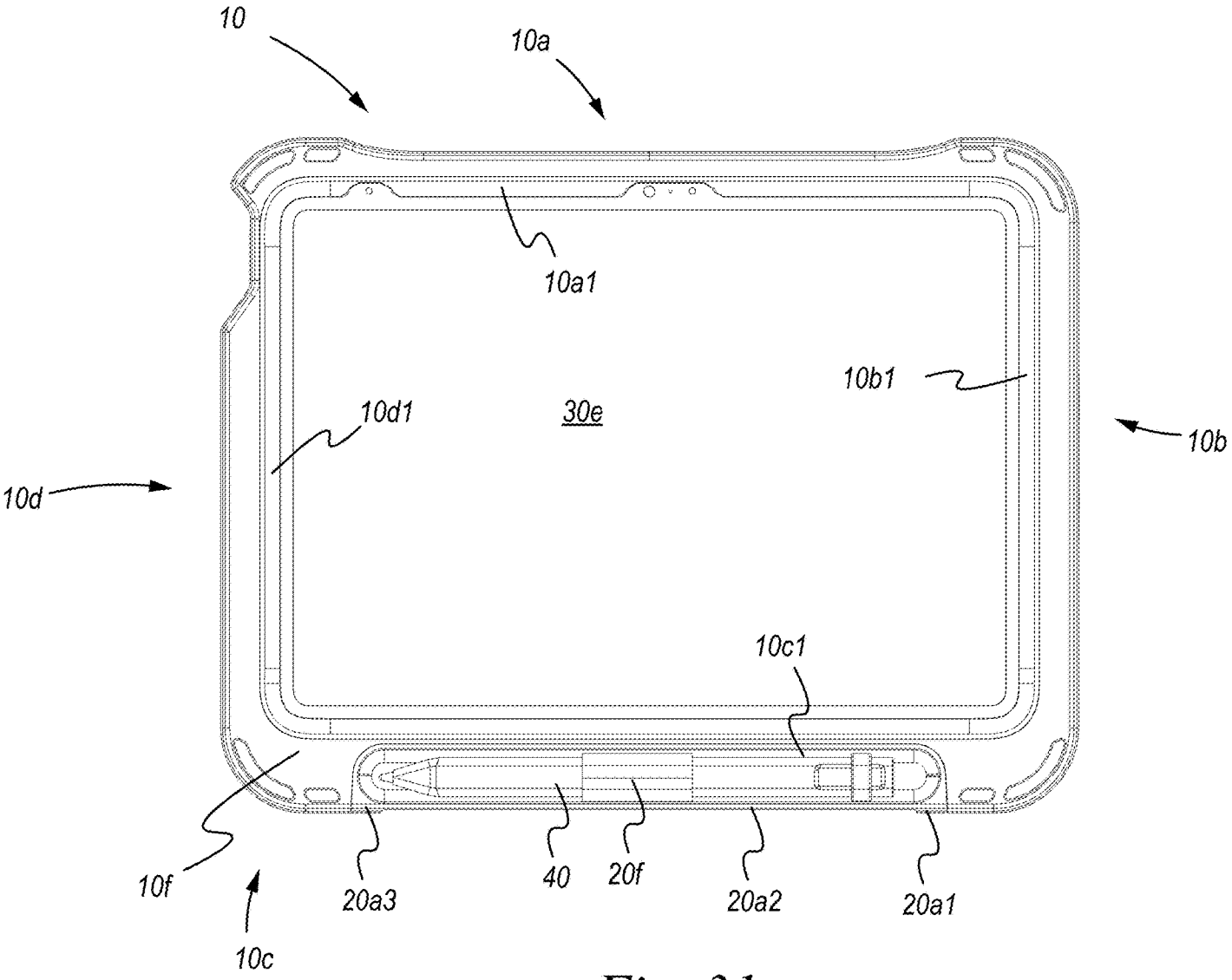
FIG. 31 is a top plan view of the assembly including the frame assembly, holder assembly, and portable electronic device.

Turning to FIG. 31, depicted therein is a top plan view of the assembly including frame assembly 10, holder assembly 20, and portable electronic device 30. In implementations, the portable electronic device may be removable from the frame assembly while the holder assembly remains coupled.

Figure 32:
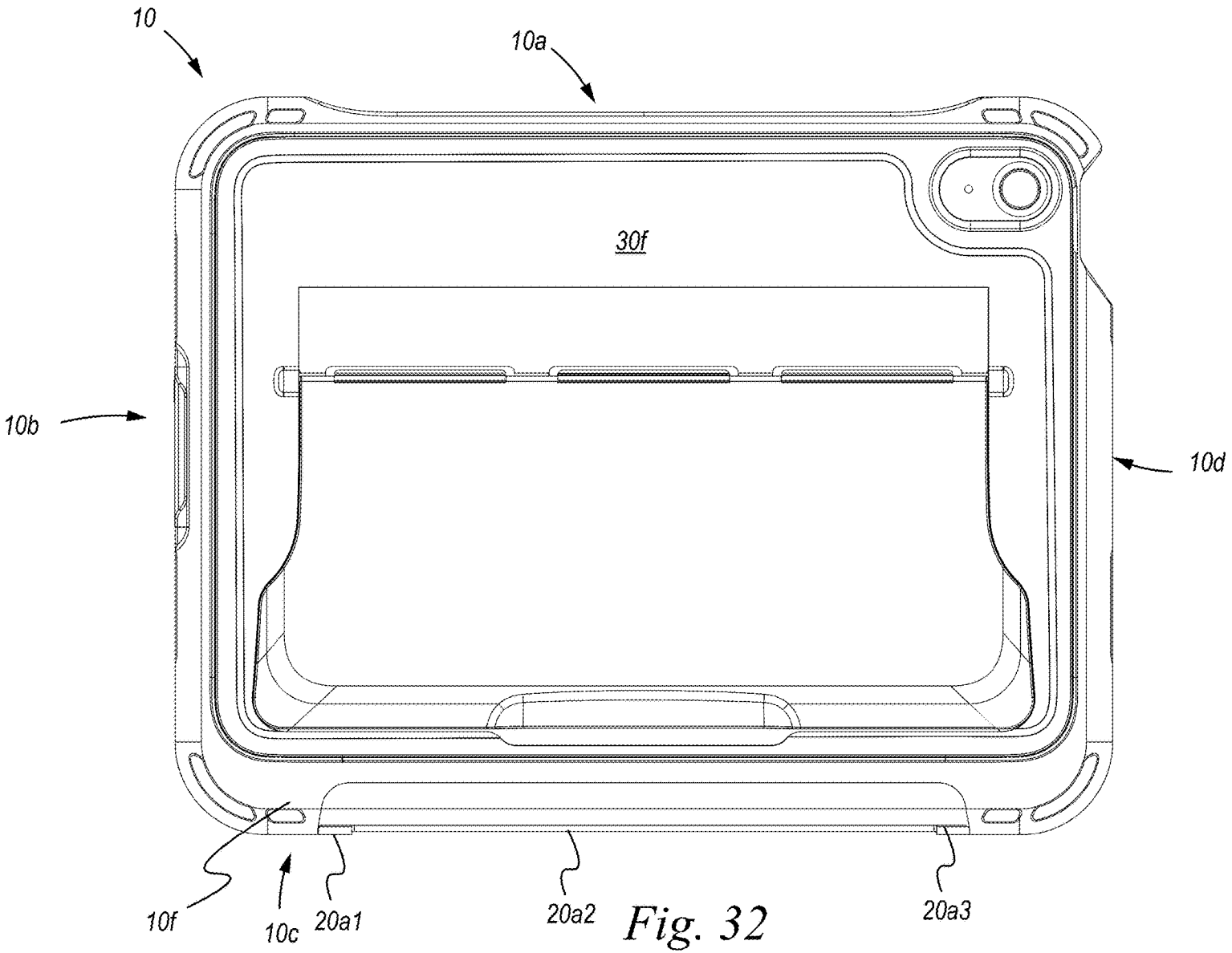
FIG. 32 is a bottom plan view of the assembly of FIG. 31.

Turning to FIG. 32, depicted therein is a bottom plan view of the assembly of FIG. 31.

Figure 33:
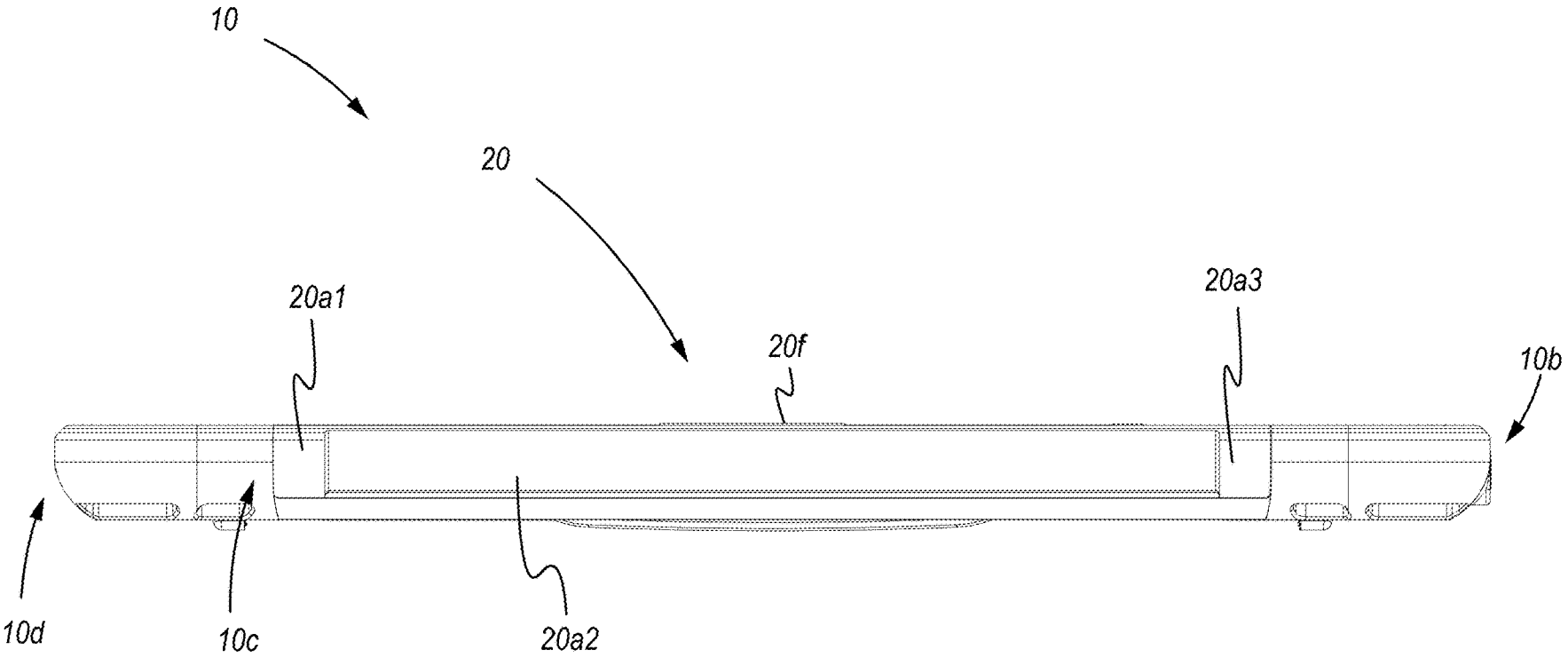
FIG. 33 is a left side elevational view of the assembly of FIG. 31.

Turning to FIG. 33, depicted therein is a left side elevational view of the assembly of FIG. 31.

Figure 34:
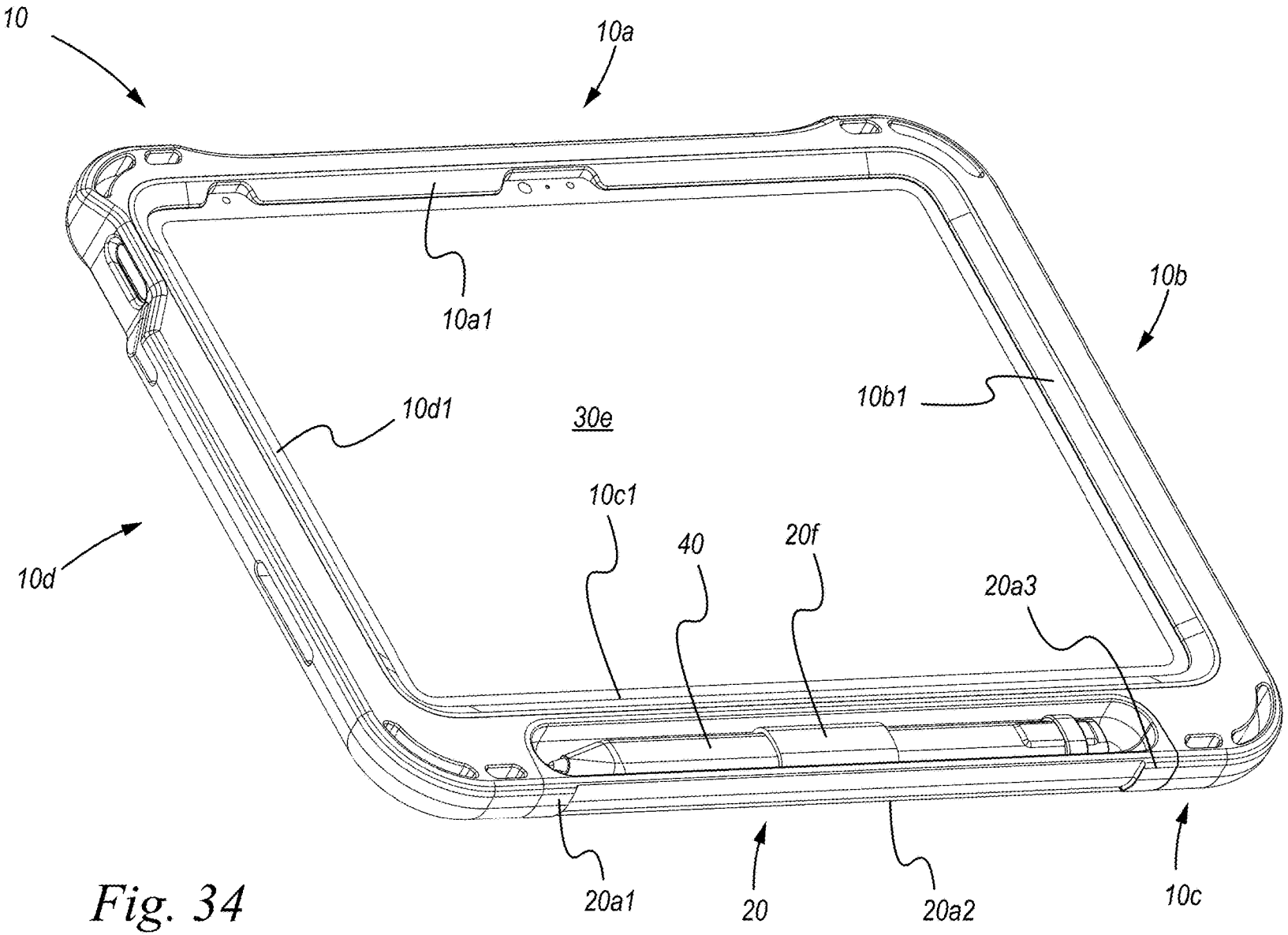
FIG. 34 is a right front top perspective view of the assembly of FIG. 31.

Turning to FIG. 34, depicted therein is a right front top perspective view of the assembly of FIG. 31.

Figure 35:
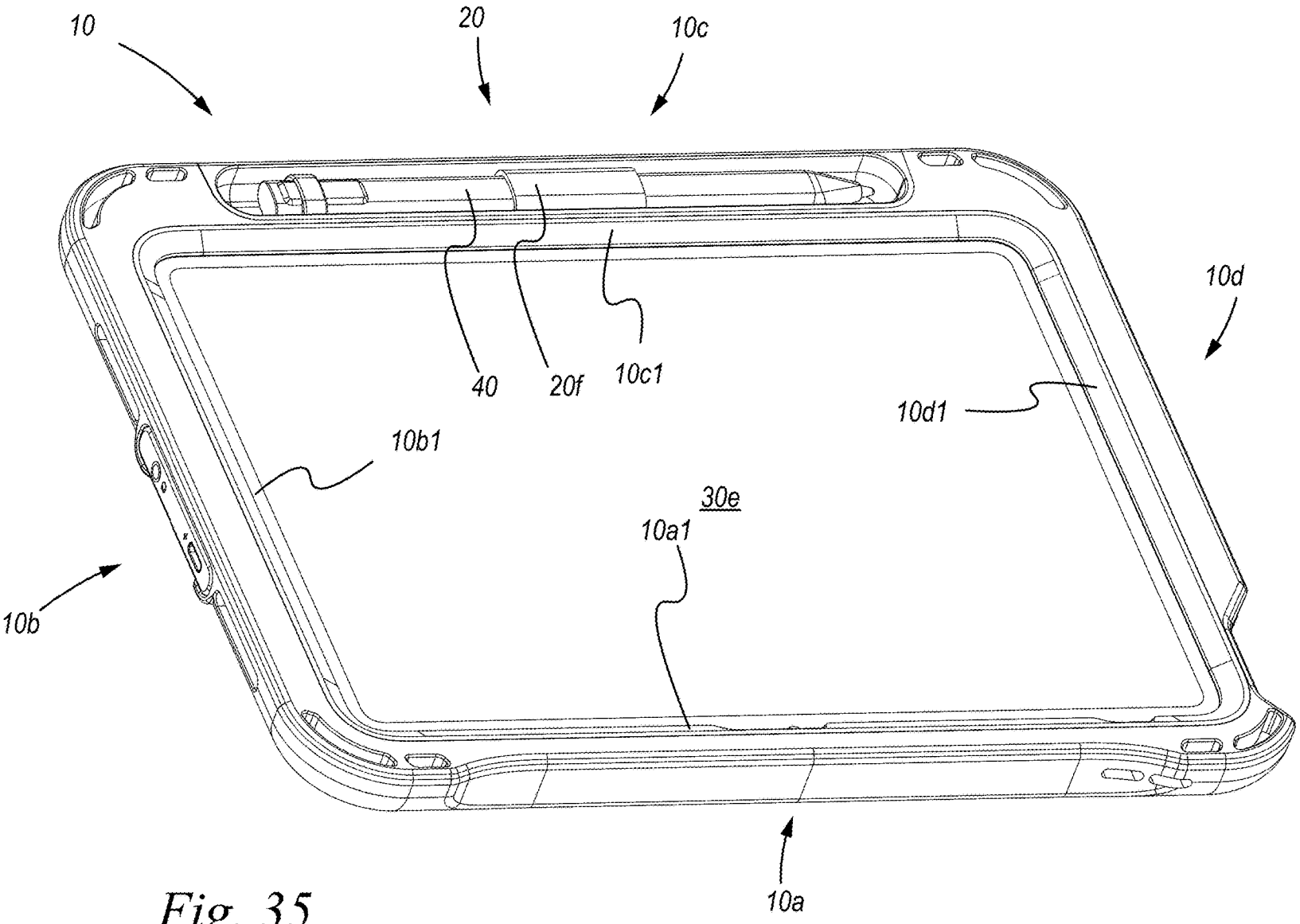
FIG. 35 is a left back top perspective view of the assembly of FIG. 31.

Turning to FIG. 35, depicted therein is a left back top perspective view of the assembly of FIG. 31.

Figure 36:
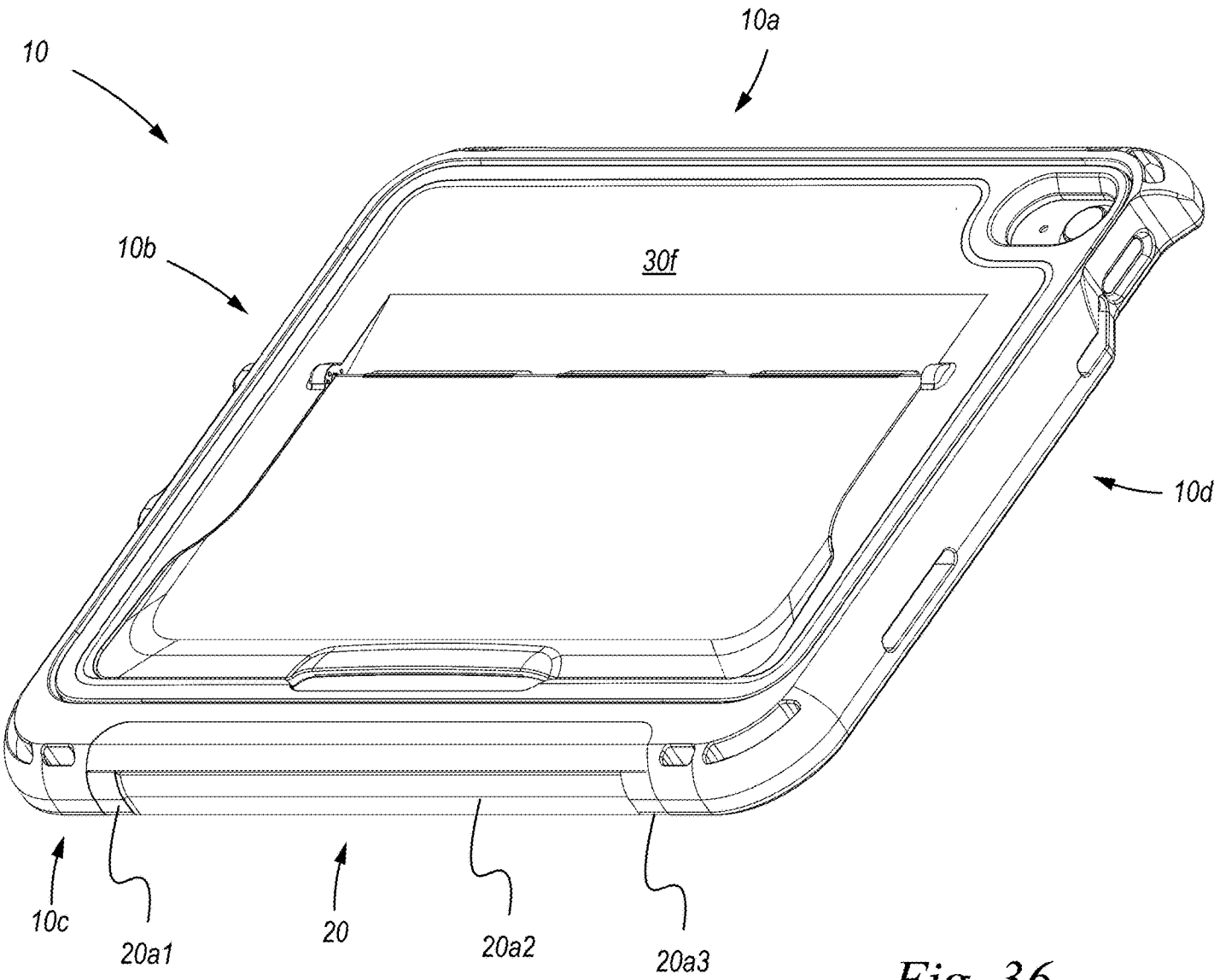
FIG. 36 is a left back bottom perspective view of the assembly of FIG. 31.

Turning to FIG. 36, depicted therein is a left back bottom perspective view of the assembly of FIG. 31.

Figure 37:
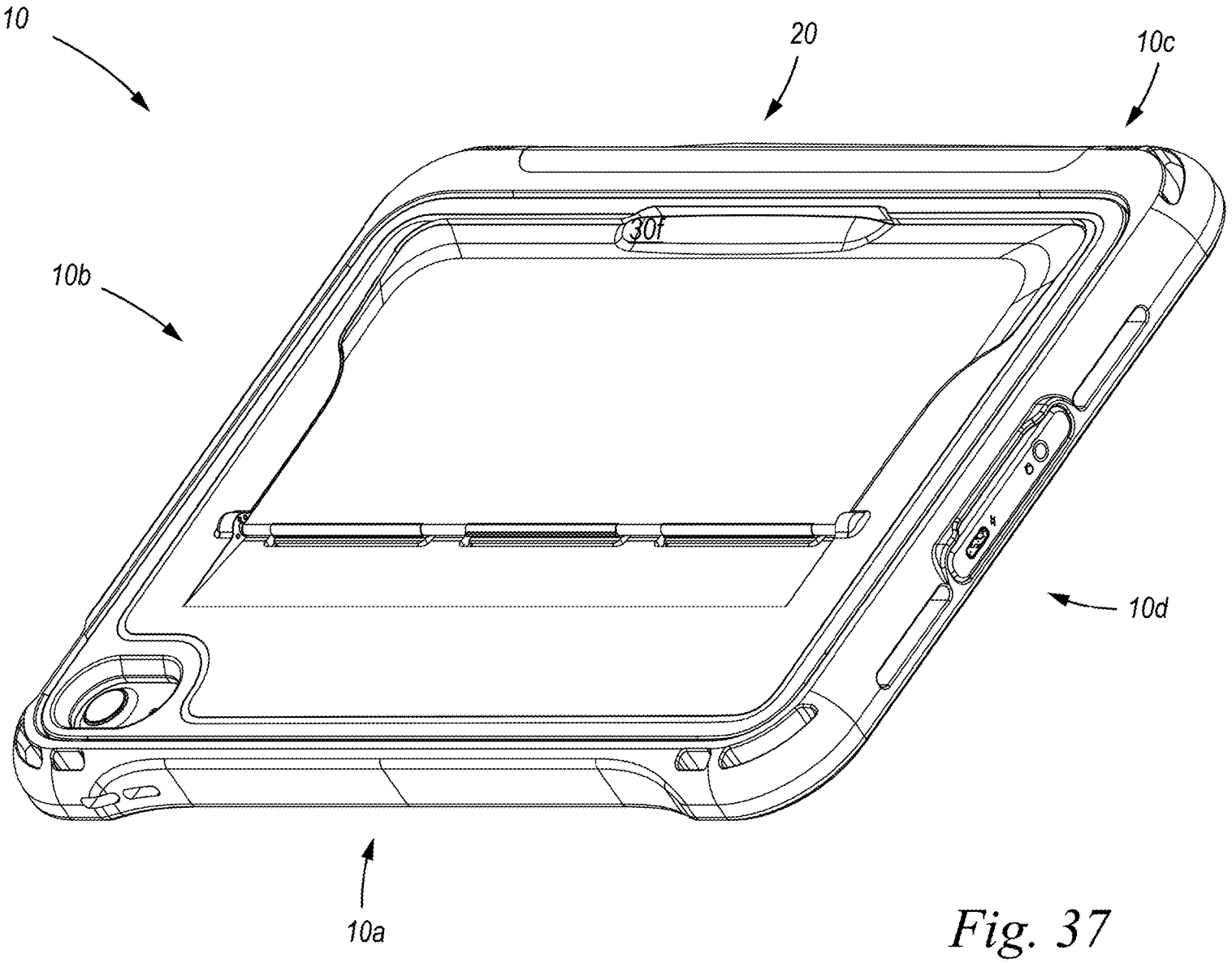
FIG. 37 is a right front bottom perspective view of the assembly of FIG. 31.

Turning to FIG. 37, depicted therein is a right front bottom perspective view of the assembly of FIG. 31.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A case system for a portable electronic device, the system comprising:

(I) a holder assembly including (A) a front wall portion having a plurality of ridge portions, (B) a trough region including a base portion and a plurality of inner wall portions, and (C) a retention member removably couplable with a stylus, pen, or pencil within the trough region, and (D) end wall portions and a back wall portion, each having outer portions removably couplable with corresponding surfaces of the frame assembly; and (II) a frame assembly including (A) a plurality of side portions, each having a flange portion and an inner wall portion, (B) a recessed structure formed at least in part by end portions, corner portions, a back portion, a base portion, and a bevelled edge portion, and (C) an aperture removably couplable with the holder assembly such that when the holder assembly is coupled with the frame assembly, the trough region is accessible for storage and retrieval of the stylus, pen, or pencil, wherein the flange portions of the frame assembly define a cavity receiving the holder assembly, and wherein the inner wall portions of the frame assembly interface with the outer portions of the holder assembly to stabilize the holder assembly.

2. The system of claim 1, wherein the end wall portions comprise a first end wall portion and a second end wall portion disposed on opposite sides of the trough region, the back wall portion extends between the first end wall portion and the second end wall portion, and the outer portions include a first outer portion of the first end wall portion, a second outer portion of the back wall portion, and a third outer portion of the second end wall portion.

3. The system of claim 1, wherein the cavity at least partially receives the first outer portion, the second outer portion, and the third outer portion to support the holder assembly relative to the frame assembly.

4. The system of claim 1, wherein the inner wall portions are positioned along different sides of the cavity and interface with respective ones of the first outer portion, the second outer portion, and the third outer portion to stabilize the holder assembly in the cavity.

5. The system of claim 4, wherein the holder assembly is insertable into and removable from the cavity without requiring tools.

6. The system of claim 5, wherein the recessed structure includes a step portion and aperture portions positioned along the recessed structure and removably couplable with corresponding features of the holder assembly to secure the holder assembly in the cavity while permitting the holder assembly to be removed from the cavity without requiring tools.

7. The system of claim 1, wherein the retention member is integrally formed with at least one of the plurality of inner wall portions of the trough region.

8. The system of claim 7, wherein the retention member that is integrally formed with at least one of the plurality of inner wall portions comprises an elastomeric or resilient material permitting repeated insertion and removal of the stylus, pen, or pencil.

9. The system of claim 8, wherein the stylus, pen, or pencil is removably receivable within the trough region and retained by the elastomeric or resilient retention member during storage in the trough region.

10. The system of claim 9, wherein the trough region and the elastomeric or resilient retention member are dimensioned to receive and retain a stylus, pen, or pencil having a predetermined diameter.

11. A case system for a portable electronic device, the system comprising:

(I) a frame assembly removably couplable with the portable electronic device, the frame assembly including a recessed structure with end portions, corner portions, and a bevelled edge portion; and (II) a holder assembly including a front wall portion with ridge portions, a trough region storing a stylus, pen, or pencil, and a retention member and end wall portions and a back wall portion having outer portions removably couplable with corresponding surfaces of the frame assembly, wherein the holder assembly is removably couplable with the frame assembly by the holder assembly being received in the recessed structure and the front wall portion of the holder assembly defines a continuous outer surface with the frame assembly when the holder assembly is received in the recessed structure.

12. The system of claim 11, wherein the ridge portions are positioned along the front wall portion adjacent the trough region and guide and align the stylus, pen, or pencil during insertion.

13. The system of claim 12, wherein the ridge portions include a first ridge portion, a second ridge portion, and a third ridge portion positioned at spaced-apart locations along the front wall portion adjacent the trough region to provide structural stiffness to the front wall portion.

14. The system of claim 13, wherein the trough region includes a base portion and a plurality of inner wall portions, and wherein the retention member is integrally formed with at least one inner wall portion of the plurality of inner wall portions and comprises an elastomeric or resilient material permitting repeated insertion and removal of the stylus, pen, or pencil.

15. The system of claim 14, wherein the holder assembly is insertable into and removable from the recessed structure without requiring tools.

16. The system of claim 15, wherein the frame assembly further comprises inner wall portions and flange portions, the flange portions defining a cavity receiving the holder assembly, and the inner wall portions interfacing with the outer portions of the holder assembly to support the holder assembly in the recessed structure.

17. A case system for a portable electronic device, the system comprising:

(I) a frame assembly including a plurality of side portions, a recessed structure with a bevelled edge portion, and an aperture; and (II) a holder assembly including a trough region receiving a stylus, pen, or pencil, and a retention member removably couplable with the stylus, pen, or pencil within the trough region, and end wall portions and a back wall portion having outer portions removably couplable with corresponding surfaces of the frame assembly, wherein the frame assembly is removably couplable with the holder assembly received in the recessed structure and the portable electronic device such that the holder assembly remains accessible for storage and retrieval of the stylus, pen, or pencil when the portable electronic device is positioned within the frame assembly.

18. The system of claim 17, wherein the portable electronic device is removably couplable with the frame assembly while the holder assembly remains received in the recessed structure and coupled with the frame assembly.

19. The system of claim 18, wherein the stylus, pen, or pencil comprises a conductive tip removably couplable with a display of the portable electronic device.

20. The system of claim 19, wherein the frame assembly and holder assembly together define a continuous exterior profile when the holder assembly is received in the recessed structure.

* * * * *